United States Patent [19]

Shindo et al.

[11] Patent Number: 4,853,295

[45] Date of Patent: Aug. 1, 1989

[54] SURFACE TREATED STEEL MATERIAL PARTICULARLY ELECTROPLATED STEEL SHEET

[75] Inventors: Yoshio Shindo; Koichi Wada; Fumio Yamazaki, all of Kimitsu, Japan

[73] Assignee: Nippon Steel Corporation, Tokyo, Japan

[21] Appl. No.: 50,529

[22] Filed: May 13, 1987

[30] Foreign Application Priority Data

May 14, 1986 [JP] Japan ..... 61-110119
May 14, 1986 [JP] Japan ..... 61-110120
May 14, 1986 [JP] Japan ..... 61-110121

[51] Int. Cl.[4] ..... B32B 15/04

[52] U.S. Cl. ..... 428/621; 428/632; 428/658; 428/659; 428/684

[58] Field of Search ..... 428/621, 632, 658, 659, 428/684, 469, 472

[56] References Cited

FOREIGN PATENT DOCUMENTS

| | | | |
|---|---|---|---|
| 58-58294 | 4/1983 | Japan . | |
| 52645 | 3/1984 | Japan | 428/659 |
| 52646 | 3/1984 | Japan | 428/659 |
| 59-89785 | 5/1984 | Japan . | |
| 59-200789 | 11/1984 | Japan . | |
| 60-96786 | 5/1985 | Japan . | |
| 60-131991 | 7/1985 | Japan . | |
| 60-141898 | 7/1985 | Japan . | |
| 60-38480 | 8/1985 | Japan . | |
| 61-64899 | 4/1986 | Japan . | |

*Primary Examiner*—Upendra Roy
*Assistant Examiner*—George Wyszomierski
*Attorney, Agent, or Firm*—Kenyon & Kenyon

[57] ABSTRACT

In the electroplated steel sheets for automobile use, the chipping resistance, water-resistant adhesion, unpainted corrosion resistance, post-painted corrosion resistance, and resistance to secular exposure are improved by superimposing a chemical conversion layer between electroplated layers of zinc and iron, nickel, cobalt, or alloys thereof.

12 Claims, 2 Drawing Sheets

SURFACE TREATED STEEL MATERIAL PARTICULARLY ELECTROPLATED STEEL SHEET

BACKGROUND OF THE INVENTION

1. Field of the Invention

The present invention relates to a surface treated steel material having a layer of Zn- or Zn series alloy-layer and/or Zn composite material plated thereon. More particularly, the present invention relates to an electroplated steel sheet provided with the above mentioned layer for an anticorrosive protection of an automobile.

2. Description of the Related Arts

The de-icing rock salt sprayed in the winter on roads in arctic districts causes the corrosion of an automobile body, and the use of various plated steel sheets for an automobile body has been considered as an corrosion control measure. The corrosion of the outer surface of an automobile body is promoted by the gravel, sprayed rock salt and the like which are thrown up from the road surface and impinge on the automobiles traveling on a road (this impingement is referred to as chipping) at a speed equal to the running speed of the automobiles, i.e., from 50 to 150 km/hour. The resultant impingement force is very high and thus the paint coating on the automobile body may peel off, or flaws reaching the steel substrate may be formed. Water from melted snow or the salt in the de-icing material will seep into the peeled parts or flaws and exert a detrimental corrosive action on the steel substrate. Accordingly, Zn plated steel sheets have been employed as a corrosion control counter measure, since the Zn plating has a strong sacrificial anode effect and thus can satisfactorily protect the steel sheet from corrosion, even though the flaws reach the steel sheet. However, when a coating of paint is applied on the Zn plated layer, as in the case of an automobile outer panel, the paint bulging referred to as blistering sometimes forms in the paint coating.

The corrosive environments to which the steel sheets of an automobile are exposed make it necessary to provide uncoated steel sheets with a corrosion resistance, and in addition, a corrosion resistance after coating, including blister resistance, water adherence resistance, red rust resistance, and flow rust resistance.

These corrosion resistances, which are improved by the Zn plated steel sheets, are further improved by a Zn-series alloy layer, such as a plated layer of Zn-Ni, Zn-Fe, Zn-Co, Zn-Fe-Cr, Zn-Ni-Co, Zn-Cr, Zn-Mn, Zn-Ti, Zn-Sn, Zn-Cu, Zn-Cd, Zn-Pd, and the like, a multilayer plated steel having a plurality of layers of the above alloys (i.e., superimposed plated layers of different compositions), a steel sheet with a graded plating layer (i.e., composition of a plated layer varies along the thickness of the layer), and a steel sheet with a composite electroplated layer(s) (i.e., particles of oxide, such as $SiO_2$, $TiO_2$, $Al_2O_3$, and the like, as well as metallic particles of Zn, Al, Cr, and the like are incorporated in the Zn plated layer. Regarding the composite electroplated layer, Japanese Unexamined Patent Publication No. 60-38480 discloses a Zn-oxide sol composite, Japanese Unexamined Patent Publication No. 60-141,898 discloses a Zn series alloy-oxide composite, and Japanese Unexamined Patent Publication No. 60-96786 discloses Zn-corrosion inhibiting pigments. The composite plating with nonmetallic particles is disclosed in Japanese Unexamined Patent Publication No. 61-64899. However, the particles precipitated and dispersed in the Zn or Zn alloy matrix are difficult to dissolve in the acidic solution and have a size which is not easily soluble.

The above described surface treated steel sheets have problems, as explained in detail below, in that, depending upon the intended environmental use of the automobiles, a further improvement in one or more of the corrosion resistances is needed.

A. The internal stress of the Zn series-alloy plated or Zn-composite plated steel sheets is higher than that of the ordinary electroplated steel sheet of Zn alone. The adherence of the former plated layer with the steel substrate (the adherence of the layer with the substrate, when in direct contact with the substrate, is hereinafter referred to as the "substrate adherence") is disadvantageously inferior to that of the latter plated layer.

B. Generally, the outer surface of an automobile body has a three-layer paint coating approximately 100 μm in total thickness and comprised of the cationic ED paint, the intercoat, and the top coat. The shrinkage stress generated during the baking of these coats has an affect on the plated layers, in that the post-coat substrate adherence is inferior to the unpainted adherence.

C. Since the ambient temperature falls to around −50° C., shrinkage of the paint coating occurs and multiplies the stress acting on the plated layer(s). This causes a reduction of the substrate adherence. Note, in the three layer-coating, there is a drastic lowering of the substrate adherence upon a fall in the temperature. When chipping occurs in a plated layer(s) exhibiting a lowered substrate adherence, the plated layer(s) of the Zn series-alloy plated or Zn-composite plated steel sheets is disadvantageously peeled off.

D. The adherence of plated layer(s) of the Zn series-alloy plated or Zn-composite plated steel sheets, in which the contact and noncontact of the plated layer(s) with the steel substrate is not taken into account, but instead, the adherence of plated layer(s) in the above steel sheets is generally considered, is hereinafter referred to as the "plating adherence". The plating adherence can be improved by interposing a covering layer consisting of one or more of Cr, Mn, Fe, Co, Ni, Cu, In, Zn, Cd, Sn, and Pb between the steel substrate and the Zn series-alloy plated layer, as disclosed in Japanese Unexamined Patent Publication No. 59-200789. In this publication, however, the plating adherence is verified under an extrusion formation (5 Erichsen bulging) of an unpainted article at an ordinary temperature, i.e., a mild condition. The interposed layer does not appear to satisfactorily improve the plating adherence under the severe conditions described in items B and/or C. Tetsu to Hagane (Bulletin of Iron and Steel Institute of Japan) 71 (1985), page 1273, discloses that a layer of one or more of Fe, Zn, Ni, Cu, and Sn interposed between the steel substrate and the Zn series-alloy plated layer provides a satisfactory plating adherence under the conditions of two coating layers, under the icing point, and in a Dupont impact test. However, an improvement in the plating adherence for a three layer coating appears to be unlikely.

E. The two-layer coating of Zn-Fe, Zn-Ni, and the like is one of the most effective methods for enhancing the water resistant adherence of the Zn series-alloy plated or Zn-composite plated steel sheets, while maintaining an excellent corrosion resistance thereof. In such a two-layer coated steel sheet, the lower plated layer consists of Zn-Fe, or Zn-Ni with a high Zn concentration, and the upper plated layer has a high Fe concentration. More specifically, Japanese Unexamined Patent Publication No. 58-58294 discloses a lower plated alloy layer consisting of Zn-Ni, and an upper plated layer of Fe or Fe-Zn alloy. Japanese Unexamined Patent Publication No. 59-89785 discloses a lower plated layer consisting of Zn, Zn-Ni alloy, or Fe-Zn alloy, and an upper plated alloy layer of Fe-Zn-Cr. Japanese Unexamined Patent Publication No. 60-131991 discloses a lower plated layer consisting of Zn or Zn alloy, and an upper plated alloy layer of Fe-P. Since in each of these disclosures the upper layer is a plated layer of Fe or Fe alloy, the phosphating film formed in the pretreating phosphating process prior to the cation ED coating can contain $Zn_2Fe(PO_4)_2.4H_2O$ (phosphophyllite) crystals in a large amount, thereby improving the poor water resistant adherence (adherence of paint coating after immersion in warm water) due to the lower Zn or Zn series-plated layer. When, however, a water resistant adherence as good as that of a cold rolled sheet is desired, at least 70% of Fe is necessary for the Fe concentration in the upper plated layer, according to research by the present inventors. On the other hand, an upper plated layer with such a high Fe concentration renders the unpainted corrosion resistance of the plated layers, as a whole, inferior to that of the lower single layer.

F. Further, an upper plated layer with such a high Fe concentration reduces the corrosion resistance after painting, so that red rust flows from the scribed parts, although such an upper plated layer is advantageous for lessening the occurrence of red rust. This appears to be attributable to a corrosion potential between the upper and lower layers so great that contact corrosion is liable to occur, and to an Fe concentration of the upper layer so high that red rusting occurs in the layer itself.

SUMMARY OF THE INVENTION

It is an object of the present invention to provide a measure which can be applied for solving a problem of a surface treated steel material with a Zn or Zn series-alloy plated layer and/or Zn-composite plated layer, so as to enhance a corrosion resistance thereof required for an intended use.

The specific object resides in a provision of a particular corrosion resistance required for a particular plated layer structure and intended use of a surface treated steel material with a Zn or Zn series-alloy plated layer and/or Zn-composite plated layer, as described in items A through F, above.

In accordance with the objects of the present invention, there is provided a steel material having at least one main plated layer of the Zn, Zn series alloy, or Zn composite material, and occasionally, an additional plated layer, and comprising a chemical conversion layer beneath any one of the plated layer(s).

The chemical conversion layer herein is interposed between the upper plated layer of the Zn, Zn series alloy, or Zn composite material. The chemical conversion layer suppresses the local cell formation between the layers, in which the chemical conversion layer is interposed, thereby enhancing the corrosion resistance.

The chemical conversion layer also plays a role of providing a base on which a plated layer of Zn, Zn series alloy, or Zn composite material is deposited, and changing a depositing behaviour in such a manner that the stresses liable to accumulate in the depositing layer are eliminated or decreased. This provides a further improved plating adherence when the Fe, Ni, and/or Co layer is plated on the steel substrate.

Preferably, the thickness of the chemical conversion layer does not exceed the following upper limit, which if exceeded, causes the plating on the chemical conversion layer to be become difficult. A preferred upper thickness of a phosphating layer is approximately 100 $mg/m^2$ of P (phosphorous). A preferred upper thickness of a chromating layer is approximately 100 $mg/m^2$ of Cr (chromium).

The chemical conversion layer on the steel sheet or a plated layer has a function of initial depositing nuclei of a plated layer deposited thereon. The plated layer therefore can be deposited in its original structure but not in the structure dependent on that of the underlying steel sheet or plated layer. The stress at the interface between the steel sheet and a plated layer, or between two plated layers, therefore decreases, thereby improving the plating adherence.

In addition, the chromate film is amorphous and the phosphating film is in the form of a number of projections on the surface thereof, thereby exhibiting a physical bonding force due to an anchoring effect, and thus enhancing the plating adherence.

Furthermore, the chemical conversion layer mitigates the impact action upon chipping.

The plating adherence is further enhanced by forming the lowermost plated layer consisting of one or more of Fe, Ni, and Co.

Since the chemical conversion layer is an insulative film, it has a function of compensating the potential difference between the upper and lower layers or sheet. The corrosion resistance is improved through this function. A difference in the corrosion potential of the plated layer of Zn, Zn-series alloy, or Zn-composite material, and the uppermost plated layer of an Fe-series alloy for improving the water-resistant adherence is such that the unpainted corrosion resistnce and post-painted corrosion reistance are impaired. A chemical conversion layer interposed between the two plated layers compensates the corrosion potential, thereby suppressing the contact type corrosion and thus enhancing the corrosion resistance. A similar effect is also realized by interposing the chemical conversion layer between the steel sheet and a plated layer.

The present invention is hereinafter described with regard to preferred embodiments.

DESCRIPTION OF THE PREFERRED EMBODIMENTS

Figure 1A:
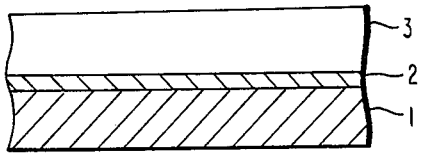
FIGS. 1 A, B and C are schematic cross sectional drawings illustrating the preferred embodiments.

In accordance with a preferred embodiment of the present invention, a chemical conversion layer is formed on the steel substrate and the objective layer then plated on the chemical conversion layer. In FIG. 1 A, reference numerals 1, 2, and 3 denote the steel sheet, the chemical conversion layer, and the plated layer of Zn, Zn-alloy, or Zn-composite material, respectively. Phosphate or chromate compound deposited in a very minute amount on the surface of a steel sheet improves a plating adherence of a plated layer thereon even under a severe condition. The deposits in a very minute amount disperse on the surface of a steel sheet in the form of small islands and act, in the subsequent electrodeposition of alloy or composite materials, as nuclei crystallites of an initial precipitation. Phosphate deposits have a pyramid form, which is peculiar to the chemical conversion phosphating, and realizes an anchoring effect between the steel sheet's surface and the plated layer, and thus creates a physical bonding therebetween. This bonding force seems to improve the plating adherence of plated layer(s) to such an extent that it is able to withstand the three layer painting, and chipping after the three layer painting. In addition, the corrosion resistance is appreciably improved by the intermediate chemical conversion layer with regard to the steel sheets with a Zn or Zn series alloy-plated layer and/or Zn composite plated layer.

A deposition amount of phosphate or chromate for effectively enhancing the plating adherence and the corrosion resistance is preferably at least 1 $mg/m^2$ in terms of P or Cr. On the other hand, when the deposition amount of phosphate or chromate exceeds 100 $mg/m^2$, the subsequent electrodeposition of a plating layer may be impeded. Regarding the phosphate compounds, a compound of phosphoric acid with one or more of metals of Zn, Fe, Ni, Co, Mn, Cu, Mo, Sn, and the like are particularly advisable.

One or more layers of a Zn layer, Zn-series alloy layer, and Zn-series composite layer is formed on the chemical conversion layer. The Zn-series alloy layer that can be formed includes an alloy layer of the Zn-series alloy, such as Zn-Ni, Zn-Fe, Zn-Co, Zn-Fe-Cr, Zn-Ni-Co, Zn-Cr, Zn-Mn, Zn-Ti, Zn-Sn, Zn-Cu, Zn-Cd, Zn-Pb, and the like, a multi-layer of these alloys (superimposed plated layers with different components or compositions), a graded layer (layer with a concentration gradient in the direction along the thickness), and the plated layers as above and containing a small amount of Al, Mg, In, or the like. A preferred content of alloying element(s) of a Zn-series alloy in the light of post-painting corrosion resistance is 20% by weight or less, particularly from 3 to 20% by weight.

The Zn-composite plated layer that can be formed on the chemical conversion layer includes an electroplated layer containing water-insoluble particles an oxide(s), such as $SiO_2$, $TiO_2$, $Al_2O_3$, $ZrO_2$, $Fe_2O_3$, and the like; carbide(s), such as SiC, TiC, and the like; nitride(s), such as SiN, BN, and the like; sulfide(s), such as $MoS_2$ and the like; graphite; corrosion-inhibiting pigments, such as $BaCrO_4$, $SrCrO_4$, $PbCrO_4$, and the like; powder of metal(s) of Zn, Al, Cr, Ni, stainless steel and the like; metallic particles treated by chromating to make the layer almost insoluble; and organic particles of phenol, epoxy resin, and the like, alone or in combination. Preferably, $SiO_2$, $TiO_2$, $Al_2O_3$, $ZrO_2$, $BaCrO_4$, $SrCrO_4$, Al powder, and Cr powder are incorporated in the plated layer, from the viewpoint of corrosion resistance. The particle size is preferably 5μ in average diameter, from the viewpoint of formability of the steel sheets. Taking into account the comprehensive quality of the corrosion resistance, the workability and the weldability, particles finer than 1μ are preferable. The average diameter herein indicates the particle diameter of the particles distributed at the greatest ratio among the total particles. A preferred content of particles of a Zn-series composite material in the light of corrosion resistance is 20% by weight or less, particularly from 0.1 to 20% by weight. A preferred deposition amount of Zn, Zn-series alloy, and Zn-composite material in the light of corrosion resistance is 5 $g/m^2$ or more.

The Zn, Zn-series alloy, or Zn composite plated layer as described above may be embodied as a multi-layer, in which the above described components of two or more plated layers are combined, from the viewpoint of the objective property, such as the post-painting corrosion resistance, plating adherence, and the like.

As the uppermost layer for enhancing the water-resistant adherence, an Fe-series alloy plating layer containing 70% or more of Fe may be provided. By providing a lowermost plated layer consisting of one or more of Fe, Ni, and Co, a synergistic effect of this layer with the chemical conversion layer is generated to the effect that a plating adherence is further enhanced.

In accordance with another preferred embodiment of the present invention, on at least one surface of a steel sheet are formed a first electroplated layer of a Zn, Zn-series alloy, Zn-composite, a chemical conversion layer on the first plated layer, and a second electroplated layer of an Fe-series alloy containing preferably at least 70% by weight of Fe.

This preferred embodiment is hereinafter referred to as the preferred embodiment with the first plated Zn alloy layer.

Referring to FIG. 1 B, in the preferred embodiment with the first plated Zn alloy layer, a Zn-series alloy plated or Zn-composite plated layer (lower layer) 3 is formed on the steel sheet 1, and a chemical conversion layer 2 is formed on the layer 3, and subsequently, an electroplated layer 4 of Fe-series alloy is formed.

Figure 1B:
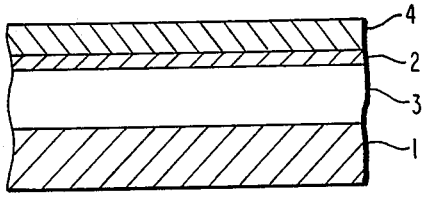
Figure 1C:
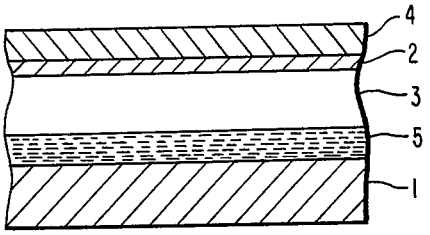

Referring to FIG. 1B, a corrosion resistance of multi-layer plated electroplated steel sheets prepared by the following method is shown. Namely, a plated layer of Zn-Ni-Co alloy (11% Ni, 0.3% Co, balance Zn) was applied at a deposition amount of 20 $g/m^2$, an intermediate chromate layer with various deposition amounts was applied on that layer, and subsequently a plated layer of Fe-Zn alloy (20% Zn, balance Fe) was applied at a deposition amount of 3 $g/m^2$. The steel sheets with a multi-layer plated steel sheets were then subjected to a phosphating process, followed by a salt spray test for three days to investigate the unpainted corrosion resistance.

Figure 2:
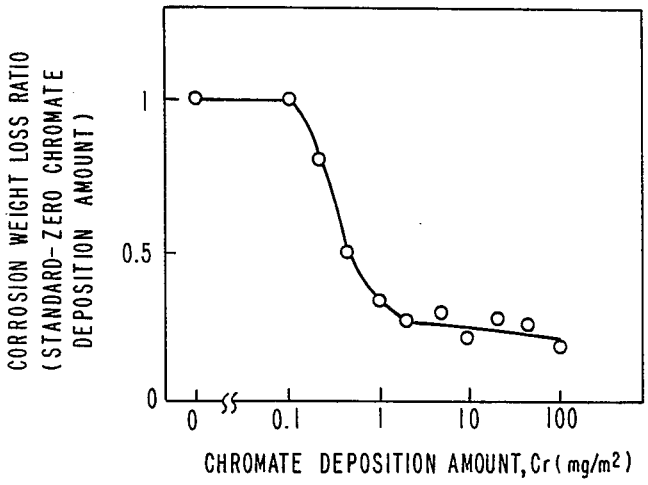
FIG. 2 shows a relationship between the deposition amount of chromate layer and a corrosion resistance (expressed by the corrosion weight loss in ratio, in which the corrosion weight loss of samples without the chromate layer is taken as a standard and the corrosion weight loss of samples with a respective deposition amount of a chromate layer is compared with the standard to obtain a ratio) with regard to the preferred embodiment with first plated layer, i.e., the first layer is a Zn-Ni-Co electroplated layer, and the second layer is an Fe-Zn electroplated layer; and, FIG. 3 refers to the same embodiment as in FIG. 2 and shows a relationship between the deposition amount of chromate layer and the post-painting corrosion resistance (red-rust resistance at the cross cut parts).

The ordinate of FIG. 2 indicates the corrosion weight loss-ratio. As understood from FIG. 2, the unpainted corrosion resistance is high at a chromate deposition amount of 0.5 $mg/m^2$ as Cr or more.

Figure 3:
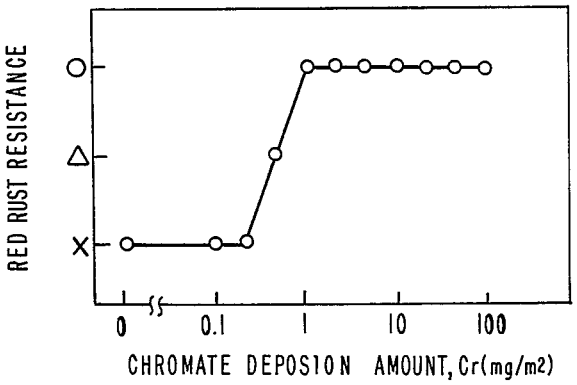

Referring to FIG. 3, the post-painted corrosion resistance of the same multi-layer electroplated steel sheets as in FIG. 2 is shown. These steels were subjected to a dip type phosphating process at a deposition amount of 2 $g/m^2$, then to a coating of a cationic ED paint (20μ), an intermediate coat, and a top coat of melamine alkyd series (each 20μ). Cross cuts were then scribed on the paint film, followed by a cyclic corrosion test (one hundred cycles) to investigate the red rust resistance. As understood from FIG. 3, the red rust-resistance is improved at a chromate layer deposition amount of at least 1 mg/m$^2$ as Cr.

The phosphating layer also improves the red rust-resistance. This chemical conversion layer interposed between the upper and lower layers is outstandingly effective in the case where the upper plated layer is an Fe-series alloy, such as Fe-Zn, Fe-Zn-Cr, and Fe-Zn-Cr. It appears that the better corrosion resistance of the Fe-series alloy plating than that of the plated layer of Fe alone synergistically improves the corrosion resistance with the interposed chemical conversion layer. A function of the chemical conversion layer is such that the interface between the Zn series-alloy or Zn-composite material of the second plated layer and Fe-series alloy of the third plated layer is made inactive, to compensate for the potential therebetween. A deposition amount of the chemical conversion layer is the same as in the above described preferred embodiment, and is preferably 100 mg/m$^2$ or less, more preferably from 1 to 100 mg/m$^2$.

The chemical conversion layer has an ability to mitigate the impact upon chipping and, therefore, enhances the plating adherence against chipping to some extent. In the preferred embodiment now described, the preferred kinds and compositions of Zn-series alloy, the preferred kinds and compositions of particles, as well as the preferred kinds and compositions of particles, as well as the preferred deposition amounts of the Zn, Zn-series alloy, and Zn-composite materials are the same as described in the other preferred embodiments.

In the preferred embodiment with the first plated layer, an Fe content of the second plated layer is preferably at least 70%, because the ratio of phosphophyllite in the chemical conversion film is enhanced and thus the water-resistant adherence is enhanced. The deposition amount of the Fe-Series second plating layer is preferably at least 1 g/m$^2$, since the phosphatizing, which is usually carried out as a pretreatment for cationic ED painting, may dissolve a surface layer at an amount of approximately 1 g/m$^2$, and if the second plated layer is dissolved, the water-resistant adherence is impaired.

The Zn-series alloy may be, for example, an Fe-Zn-Cr alloy containing from 3 to 29% by weight of Zn and from 0.1 to 1% by weight of Cr, an Fe-Zn alloy containing from 3 to 30% by weight of Zn, and an Fe-P alloy containing from 0.01 to 30% by weight of P.

In accordance with still another preferred embodiment of the present invention, a covering or first layer consisting of at least one deposited metal of Fe, Ni, and Co is formed on the steel substrate, a second plated layer of Zn, Zn-series alloy or Zn composite material is formed on the covering layer, a chemical conversion layer is formed on the second plated layer, and a third plated layer of Fe-series alloy containing at least 70% by weight is formed on the chemical conversion layer. This embodiment is hereinafter referred to as the preferred embodiment with the first deposited metal and attains an improved plating adherence under severe conditions. In FIG. 1 C, the reference numerals 1, 5, 3, 2, and 4 denote the steel sheet, the Fe, Ni, and/or Co layer, the plated layer of Zn, Zn-series alloy, or Zn-composite material, the chemical conversion layer, and the plated layer of Fe-series alloy, respectively. Namely, in this preferred embodiment, the lowermost plated layer of one or more of Fe, Ni, and Co is added to the layer structure of the above described preferred embodiments, thereby improving the plating adherence at a low temperature, which is not yet complete in the above described preferred embodiments. More specifically, the surface of a steel sheet undergoes the usual heating, rolling, pickling, and annealing and has, therefore, a diffusion concentrated layer of such nonmetals as C, Si, and the like, and a compound thereon, with the result that the plating adherence is impeded by the diffusion. concentrated layer and the like present on the steel surface. Such impedance is serious in the case of Zn-series alloy and Zn-series composite material, since the layer structure is complicated compared with the plated layer structure of a single metal, such as Zn. The covering or first layer consisting of at least one deposited metal of Fe, Ni, and Co in accordance with the preferred embodiment with the first deposited metal has a simple metal structure and can enhance the plating adherence of the Zn series-alloy plated or Zn-composite plated layer, due to the intermediate presence thereof between the steel substrate and the Zn series-alloy plated or Zn-composite plated layer. The Fe of the first layer is the same material as that of the steel substrate, and the Ni and Co are of the same iron group as the Fe. These factors appear to give the Fe, Ni, and Co a good substrate adherence. In addition, the Fe, Ni, and Co provide a good plating adherence of the Zn series-alloy plated or Zn-composite plated layer. The steel sheet having only the first layer is, however, not highly resistant to chipping at a low temperature. It was discovered that, by applying the first plated layer to the above described preferred embodiments, a satisfactory plating adherence is atained even at a hard condition of chipping at a low temperature, due to a synergistic effect of the first layer and the mitigating effect on the chipping impact of the chemical conversion layer.

In the preferred embodiment now described, the preferred deposition amount of the chemical conversion layer, the preferred kinds and compositions of Zn-series alloy, the preferred kinds and compositions of particles, the preferred deposition amounts of the Zn, Zn-series alloy, and Zn-composite materials, as well as the preferred deposition amounts and composition of the Fe-series alloy, are the same as described in the other preferred embodiments. A preferred deposition amount of the first plated layer in the light of plating adherence is 0.01 g/m$^2$ or more, particularly from 0.01 to 2 g/m$^2$.

As the chemical conversion layer of the above described three preferred embodiments, a chromate, phosphate, molybdenate, oxalate, titanate, or tannate layer is effective, but the chromate and phosphate layers are the most effective. The chromating and phosphating method may be any of the ordinary methods, such as the electrolytic method, dip method, spary method. Particularly, the electrolytic method is desirable, since a uniform deposition is attained by this method.

The method for producing a plated steel sheet according to the present invention is hereinafter described. This plated steel sheet can be obtained by subjecting a steel sheet to a pretreatment by an ordinary degreasing (dipping, spraying, counterflow or electrolytic method with the aid of a degreasing agent such as strong alkali, weak alkali, solvent, or the like) or ordinary pickling (dipping, spraying, counterflow or electrolytic method with the aid of a pickling agent such as sulfuric acid and chloric acid), and then to a successive application of layers, such as a chemical conversion layer and a Zn-series alloy plated layer.

The bath for electrolytic chromating contains, as a main agent, $CrO_3$, and, as auxiliary agent, chromate of $Cr^{3+}$, $Zn^{2+}$, $Fe^{2+}$ $Ni^{2+}$, and $Mn^{2+}$, as well as sulfuric acid, hydrochloric acid, and nitric acid. In such a bath, the chromating is carried out at a bath temperature of from 30° to 50° C., a current density of from 2 to 30 A/dm$^2$, and a flow speed of from 1 to 10 m/min. The concentration of the main component, i.e., $CrO_3$, is from 10 to 50 g/l. After the electrolytic chromating, the water rinsing is carried out at ordinary temperature but is preferably carried out by using hot water with a temperature of from 90° to 100° C. After the water rinsing, heating to a temperature of from 50° to 300° C. may be carried out.

The bath for electrolytic phosphating contains, as a main agent, $Zn^{2+}$, $Fe^{2+}$, $Ni^{2+}$, $Mn^{2+}$, $Na^{2+}$, $K^{1+}$, salt of $HPO_4^{2-}$, $H_2PO_4^{-}$, $H_2PO_3^{-}$, as well as, as an adjusting agent, sulfuric acid, hydrochloric acid, phosphoric acid, caustic soda, and caustic potash. In such a bath, the phosphating is carried out at a bath temperature of from 20° to 60° C., a current density of from 2 to 200 A/dm$^2$, and a flow speed of from 1 to 100 m/min. The concentration of main components in the bath is from 10 to 200 g/l.

The bath for electroplating a Zn-series alloy contains, as a main agent, chloride, sulfate, borofluoride, or sulfanate of $Zn^{2+}$, $Fe^{2+}$, $Ni^{2+}$, $Co^{2+}$, $Cr^{6+}$, $Cr^{3+}$, $Mn^{2+}$, $Ti^{2+}$, $Sn^{2+}$, $Cu^{2+}$, $Cd^{2+}$, and $Pb^{2+}$. In such an electroplating bath, the plating is carried out at a pH of from 0.5 to 13.5, a bath temperature of from 20° to 70° C., a current density of from 10 to 300 A/dm$^2$, and a flow speed of from 10 to 300 m/min. The concentration of main component(s), i.e., $Zn^{2+}$, $Fe^{2+}$, $Ni^{2+}$, $Co^{2+}$, $Cr^{6+}$, $Cr^{3+}$, $Mn^{2+}$, $Ti^{2+}$, $Sn^{2+}$, $Cu^{2+}$, $Cd^{2+}$, $Pb_{2+}$, is from 30 to 100 g/l. By adjusting the proportion of the main agents it is possible to vary the electrodeposition ratio of $Zn^{2+}$, $Fe^{2+}$, $Ni^{2+}$, $Co^{2+}$, $Cr^{6+}$, $Cr^{3+}$, $Mn^{2+}$, $Ti^{2+}$, $Sn^{2+}$, $Cu^{2+}$, $Cd^{2+}$, and $Pb^{2+}$, in an electroplated layer.

In the plating of Zn-series composite material, water-insoluble particles, which may be any one of colloid, sol, and powder, are incorporated into the plating bath of metallic Zn or Zn alloy. When the particles are an organic compound, the surface active agent should be added to the plating bath. The plating of the Zn-series composite material is carried out at a pH of from 0.5 to 5, a bath temperature of from 30° to 70° C., a current density of from 5 to 300 A/dm$^2$, and a flow speed of from 10 to 300 m/min.

The plating bath may have a vertical type- or horizontal type-structure. The current source of plating may be a direct current source. The pulse current source or superimposed, direct current and alternating current source, by which the cathode electrolysis is made high, can be used without particular hindrance. When a multilayer of the composite material is formed, the separate baths are settled for forming the respective plated layers, so that the concentrations of main agents are different from one another. The multilayer are successively formed in the respective baths. When the graded layer is formed, the multiplayer plating method is carried out in such manner that the current density in each bath is different.

The bath for electroplating an Fe-series alloy contains, in the case of Fe-Zn alloy, as a main agent, chloride, or sulfate of $Zn^{2+}$, $Fe^{2+}$, and, as an auxiliary agent, chloride, sulfate, or borofluoride of K, Na, $NH_4$, Mg, Al, and the like, as well as, as a pH-adjusting agent, an acid such as sulfuric acid, hydrochloric acid, and the like, and carbonate of Na, Mg, Sr, and the like. In such a bath, the plating is carried out at a pH of from 0.5 to 3.0, a bath temperature of from 30° to 70° C., a current density of from 50 to 300 A/dm$^2$, and a flow speed of from 10 to 300 m/min. The concentration of main component(s), i.e., $Zn^{2+}$, and $Fe^{2+}$, is from 70 to 100 g/l in total. The proportion of $Fe^{2+}$ to $Zn^{2+}$ is 100~10:1. The electroplating of the Fe-Zn-Cr alloy can be carried out by a plating bath, to which a chloride or sulfate of $Cr^{3+}$ is added in such a concentration that the $Cr^{3+}$ is from 1/10 to 1/100 relative to the $Fe^{2+}$ concentration.

The electroplating of an Fe-P alloy can be carried out by a plating bath, to which a phosphite or hypophosphite of a nonmetal, such K, Na, $NH_4$ is added, and having a concentration such that the P is from 1/10 to 1/1000 relative to the $Fe^{2+}$ concentration.

Regarding the electroplating of Fe, Ni, or Co alone, or two or more of these metals, the main agent as chloride or sulfate of Co, in the case of electroplating of Co alone, and the auxiliary agents as chloride, sulfate, or borate of K, Na, $NH_4$, Mg, Al, and the like are used. In addition, pH-adjusting agent, such as acid, e.g., sulfuric acid, hydrochloric acid, or carbonate of Na, Mg, Sr, and the like are used to adjust pH to 0.5 to 3.0. In such an electroplating bath, the plating is carried out at a current density of from 10 to 300 A/dm$^2$ and a flow speed of 10 to 300 m/min. The concentration of the main component, i.e., $Co^{2+}$, is from 30 to 100 g/l. The single plating other than Co can be obtained as above by substituting $Co^{2+}$, for $Fe^{2+}$ or $Ni^{2+}$. The plating of two or more metals can be obtained by appropriately mixing the respective main components in the identical bath.

The plating bath may have a vertical type- or horizontal type-structure. The current source of plating may be a direct current source. The pulse current source or superimposed, direct current and alternating current source, by which the cathode electrolysis is made high, can be used without particular hindrance.

The plated layer structures as described above need not be applied to both sides of a steel sheet but may be applied on only one side thereof, in accordance with the intended use. The side of a steel sheet on which the layer structure according to the present invention is not applied may be the steel surface as it is, or may be the side provided with another layer structure, for example, a Zn-series alloy plated layer having an organic coating thereon.

The steel substrate to which the surface layer according to the present invention is applied is usually a soft sheet sheet finished by dull rolling. A bright finished soft steel sheet, a high tensile steel sheet containing a large amount of Mn, Si, P, and the like, a high corrosion resistant steel sheet containing a large amount of Cr, Cu, Ni, and the like, and steel materials in miscellaneous forms such as a rod, bar, pipe, and the like, can be used as a substrate material according to the present invention.

EXAMPLE 1

The various electroplated steel sheets according to the present invention and the steel sheets plated by the methods other than the present invention were subjected to the three layer-coating process for automobile and to the evaluation test of the plating adhesion under chipping at a low temperature, and then to the evaluation test of the plating adherence, low temperature, unpainted corrosion resistance, water-resistant adherence, and post-painting corrosion resistance.

Table 1 shows the paint coating conditions, testing conditions, and evaluation criterions.

Tables 2 (A) through 2 (D) correspond to the preferred embodiments with a chemical conversion layer between the steel sheet and the plated layer. Specifically, in Table 2 (A), a layer structure with a chemical conversion, chromating layer, and a main plated layer of Zn-series alloy plating; in Table 2 (B), a layer structure with a chemical conversion, chromating layer, and a main plated layer of Zn-series composite material plating; in Table 2 (C), a layer structure with a chemical conversion, phosphating layer, and a main plated layer of Zn-series alloy plating; and in Table 2 (D), a layer structure with a chemical conversion, phosphating layer, and a main plated layer of Zn-series composite material plating is shown.

In Tables 2 the samples marked with an asterisk are comparative, and the other samples are of the present invention.

The samples 1, 2, 3, 20, 22, 24, 26, and 28 in Tables 2 (A) and 2 (C), and samples 1, 2, 3, 19, 21, 23, 25, and 27 in Tables 2 (B) and 2 (D) do not have the chemical conversion layer, and thus exhibit a poor (X, Δ), plating adherence, unpainted corrosion resistance, and post-painted corrosion resistance. Contrary to this, the samples according to the present invention exhibit an improvement in any of the plating adherence, unpainted corrosion resistance, and post-painted corrosion resistance (Δ and o marks). The samples 4 and 7 in Tables 2 (A), (B), (C), and (D) have a small deposition amount of the chemical conversion layer and, therefore, exhibit a poorer corrosion resistance (Δ mark and the like) than the other samples according to the present invention. The samples 21, 25 in Tables 2 (A) and (C) as well as samples 22, 24, 26 in Tables 2 (B) and (D) have as the upper layer an Fe-rich Fe-series alloy plated layer and, therefore, exhibit an improved water-resistant adherence (o mark). The samples 27, 29 in Tables 2 (A) and (C) as well as sample 28 in Tables 2 (B) and (D) have as the lower layer an Ni or Co plated layer and, therefore, exhibit a further improved plating adherence (o mark).

TABLE 1

| | |
|---|---|
| Treatments of Samples | (1) Size of samples: 0.8 mm × 70 mm × 150 mm<br>(2) Chemical conversion treatment: Dip type zinc phosphating<br>(3) ED coating: cation type-film thickness 20 μ<br>(4) intermediate coating: alkyd type film thickness 40 μ<br>(5) top coating: melamine alkyd coating film thickness 40 μ |
| Testing Method | 1. Plating Adherence (Chipping test at low temperature)<br>Samples, which have undergone the top coating treatment (5), are subjected to a chipping test at a low temperature<br>(a) chips: 300 graves for road 0.5~1.0 g/piece<br>(b) chipping: the above chips are impinged on samples cooled to −50° C. at a speed of 150 km/h by means of high pressure air.<br>2. Unpainted Corrosion resistance Samples which have undergone the chemical conversion treatment (2) are subjected to salt spray test (JIS 22371) for 3 days.<br>3. Water-resistant adherence<br>Samples, which have undergone the top coating treatment (5), are subjected to an immersion test in distilled water at 40° C. for 10 days.<br>4. Post-painting corrosion resistance<br>Samples, which have undergone the top coating treatment (5), are scribed to form cross cuts and then subjected to the cyclic corrosion test for 100 cycles.<br>(a) Salt spray JIS-Z2371<br>6 hours<br>(b) Drying 60° C. 6 hours<br>(c) humid RH95%<br>40° C.<br>6 hours<br>(d) Cooling −20° C. 6 hours |
| Evaluation Criterion | (1) Adherence of plating<br>Under above low temperature-chipping<br>(a) peeling of plating at 1% or more of sample's surface area - x failure<br>(b) peeling of a plating at less than 1% of sample's surface area - Δ slight failure<br>(c) no peeling of plating - o good |

TABLE 1-continued (2) Unpainted Corrosion resistance. Standard is determined for a sample which has the same composition and deposition amount as the sample to be evaluated but does not have a chemical conversion layer.
The corrosion weight loss of a sample to be evaluated is compared with the standard sample, to obtain a ratio.
Ratio of less than 0.4 - o
Ratio of 0.4-less than 0.9 - Δ
Ratio of 0.9 or more - x (3) Water resistant adherence
Hundred squares 2 mm on each side. Number of squares peeled by a tape 0/100 - o
less than 5/100 - Δ
5/100 or more - x (4) Post-painting corrosion resistance
Red rust resistance at cross cut parts
minute flowing rust - good
large flowing rust - poor
Blister resistance at cross cut parts
maximum blister width of less than 3 mm - good
"3 mm or more - poor
Comprehensive evaluation
both good red rust resistance
and blister resistance - o
either resistance poor -Δ
both resistances poor - x

TABLE 2(A)

| Sample | Chemical Conversion Film: Kind of Film | Chemical Conversion Film: Deposition Amount ($mg/m^2$) | Plated Layer: Number of Layer(s) or Graded Layer | Plated Layer: Deposition Amount ($g/m^2$) | Plated Layer: Kind of Plating | Plating Adherence | Unpainted Corrosion Resistance | Water Resistant Adherence | Post-painting Corrosion Resistance |
|---|---|---|---|---|---|---|---|---|---|
| 2A-1* | — | — | 1 | 20 | 12% Ni - balance Zn | x | x | Δ | x |
| 2* | — | — | 1 | 20 | 10% Fe - balance Zn | x | x | Δ | x |
| 3* | — | — | 1 | 20 | 10% Ni - balance Zn | x | x | Δ | x |
| 4 | Chromate Film | 0.2 | 1 | 20 | 12% Ni - balance Zn | Δ | Δ | Δ | Δ |
| 5 | " | 2 | 1 | 60 | 10% Co - balance Zn | Δ | o | Δ | o |
| 6 | " | 20 | 1 | 40 | 10% Ni - 5% Fe - balance Zn | Δ | o | Δ | o |
| 7 | " | 0.5 | 1 | 20 | 10% Fe - balance Zn | Δ | Δ | Δ | Δ |
| 8 | " | 2 | 1 | 50 | 5% Cr - balance Zn | Δ | o | Δ | o |
| 9 | " | 20 | 1 | 40 | 20% Fe - 5% Co - balance Zn | Δ | o | Δ | o |
| 10 | " | 10 | 1 | 40 | 35% Mn - balance Zn | Δ | o | Δ | o |
| 11 | " | 100 | 1 | 20 | 10% Ni - balance Zn | Δ | o | Δ | o |
| 12 | " | 10 | 1 | 40 | 15% Ti - balance Zn | Δ | o | Δ | o |
| 13 | " | 100 | 1 | 80 | 50% Sn - balance Zn | Δ | o | Δ | o |
| 14 | " | 1 | 1 | 5 | 30% Cu - balance Zn | Δ | o | Δ | o |
| 2A-15 | Chromate Film | 45 | 1 | 100 | 35% Cd - balance Zn | Δ | o | Δ | o |
| 16 | " | 7 | 1 | 30 | 10% Ni - 0.1% Cr - balance Zn | Δ | o | Δ | o |
| 17 | " | 65 | 1 | 60 | 18% Pb - balance Zn | Δ | o | Δ | o |
| 18 | " | 20 | 1 | 40 | 15% Fe - 1% Cr - balance Zn | Δ | o | Δ | o |
| 19 | " | 20 | 1 | 40 | 12% Ni - balance Zn | Δ | o | Δ | o |
| 20* | — | — | 2 | (Upper Layer) 5<br>(Lower Layer) 20 | 80% Fe - balance Zn<br>20% Fe - balance Zn | x | x | o | x |
| 21 | Chromate Film | 20 | 2 | " | " | Δ | o | o | o |
| 22* | — | — | 3 | (Upper Layer) 5<br>(Middle Layer) 10<br>(Lower Layer) 20 | 15% Ni - balance Zn<br>9% Ni - balance Zn<br>3% Ni - balance Zn | x | x | Δ | x |
| 23 | Chromate Film | 20 | 3 | " | " | Δ | o | Δ | o |
| 24* | — | — | Graded | 30 | (Uppermost Layer) 90% Fe - balance Zn<br>(Lowermost Layer) 5% Fe - balance Zn | x | x | o | x |
| 25 | Chromate Film | 20 | Graded | 30 | " | Δ | o | o | o |
| 2A-26* | — | — | 2 | (Upper Layer) 20<br>(Lower Layer) 1 | 12% Ni - balance Zn<br>Ni | x~Δ | x | Δ | x |
| 27 | Chromate Film | 20 | 2 | " | " | o | o | Δ | o |
| 28* | — | — | 2 | (Upper Layer) 20<br>(Lower Layer) 1 | 10% Fe - balance Zn<br>Co | x~Δ | x | Δ | x |
| 29 | Chromate Film | 20 | 2 | " | " | o | o | Δ | o |

Remarks: *Comparative

TABLE 2 (B)

| Sample | Chemical Conversion Film: Kind of Film | Chemical Conversion Film: Deposition Amount ($mg/m^2$) | Plated Layer: Number of Layer(s) or Graded Layer | Plated Layer: Deposition Amount ($g/m^2$) | Plated Layer: Kind of Plating | Plating Adherence | Unpainted Corrosion Resistance | Water Resistant Adherence | Post-painting Corrosion Resistance |
|---|---|---|---|---|---|---|---|---|---|
| 2B-1* | — | — | 1 | 20 | 5% $SiO_2$ - 10% Ni - balance Zn | x | x | Δ | x |
| 2* | — | — | 1 | 20 | 5% $TiO_2$ - 10% Ni - balance Zn | x | x | Δ | x |
| 3* | — | — | 1 | 30 | 8% SiC - balance Zn | x | x | Δ | x |
| 4 | Chromate Film | 0.2 | 1 | 20 | 5% $SiO_2$- 10% Ni - balance Zn | Δ | Δ | Δ | Δ |
| 5 | " | 2 | 1 | 30 | " | Δ | o | Δ | o |
| 6 | " | 20 | 1 | 50 | 5% $Al_2O_3$ - 10% Co - balance Zn | Δ | o | Δ | o |
| 7 | " | 0.5 | 1 | 20 | 5% $SiO_2$ - 10% Ni - balance Zn | Δ | Δ | Δ | Δ |
| 8 | " | 5 | 1 | 30 | " | Δ | o | Δ | o |
| 9 | " | 20 | 1 | 50 | 5% $ZrO_2$ - 10% Fe - balance Zn | Δ | o | Δ | o |
| 10 | " | 10 | 1 | 80 | 10% Cr particles - balance Zn | Δ | o | Δ | o |
| 2B-11 | Chromate Film | 100 | 1 | 40 | 10% Al particles - balance Zn | Δ | o | Δ | o |
| 12 | " | 10 | 1 | 100 | 5% $PbCrO_4$ particles - balance Zn | Δ | o | Δ | o |
| 13 | " | 100 | 1 | 60 | 3% $SiO_2$ - 15% Fe - balance Zn | Δ | o | Δ | o |
| 14 | " | 1 | 1 | 10 | 2% $TiO_2$ - 15% Co - balance Zn | Δ | o | Δ | o |
| 15 | " | 45 | 1 | 5 | 15 $Al_2O_3$ - 10% Ni - balance Zn | Δ | o | Δ | o |
| 16 | " | 7 | 1 | 30 | 8% $ZrO_2$ - balance Zn | Δ | o | Δ | o |
| 17 | " | 65 | 1 | 20 | 5% $BaCrO_4$ - 10% Ni - balance Zn | Δ | o | Δ | o |
| 18 | " | 20 | 1 | 20 | " | Δ | o | Δ | o |
| 19* | — | — | 2 | (Upper Layer) 20 | 5% $SiO_2$ - 10% Ni - balance Zn | x | x | Δ | x |
| | | | | (Lower Layer) 5 | 10% Ni - balance Zn | Δ | o | Δ | o |
| 20 | Chromate Film | 20 | 2 | " | " | | | | |
| 2B-21* | — | — | 2 | (Upper Layer) 5 | 80% Fe - balance Zn | x | x | o | x |
| | | | | (Lower Layer) 20 | 5% $TiO_2$ - 10% Fe - balance Zn | | | | |
| 22 | Chromate Film | 20 | 2 | " | " | Δ | o | o | o |
| 23* | — | — | 3 | (Upper Layer) 5 | 80% Fe - balance Zn | | | | |
| | | | | (Middle Layer) 20 | 5% $Al_2O_3$ - 10% Ni - balance Zn | x | x | o | x |
| | | | | (Lower Layer) 20 | 10% Co - balance Zn | | | | |
| 24 | Chromate Film | 20 | 3 | " | " | Δ | o | o | o |
| 25* | — | — | 3 | (Upper Layer) 5 | 80% Fe - balance Zn | x | x | o | x |
| | | | | (Middle Layer) 10 | Zn | | | | |
| | | | | (Lower Layer) 30 | 5% $BaCrO_4$ - 10% Co - balance Zn | | | | |

TABLE 2 (B)-continued

| Sample | Chemical Conversion Film: Kind of Film | Chemical Conversion Film: Deposition Amount ($mg/m^2$) | Plated Layer: Number of Layer(s) or Graded Layer | Plated Layer: Deposition Amount ($g/m^2$) | Plated Layer: Kind of Plating | Plating Adherence | Unpainted Corrosion Resistance | Water Resistant Adherence | Post-painting Corrosion Resistance |
|---|---|---|---|---|---|---|---|---|---|
| 26 | Chromate Film | 20 | 3 | " | " | Δ | o | o | o |
| 27* | — | — | 2 | (Upper Layer) 20 | 5% $SiO_2$ - 10% Ni - balance Zn | x~Δ | x | Δ | x |
| | | | | (Lower Layer) 1 | Ni | | | | |
| 28 | Chromate Film | 20 | 2 | " | " | o | o | Δ | o |

Remarks: *Comparative

TABLE 2 (C)

| Sample | Chemical Conversion Film: Kind of Film | Chemical Conversion Film: Deposition Amount ($mg/m^2$) | Plated Layer: Number of Layer(s) or Graded Layer | Plated Layer: Deposition Amount ($g/m^2$) | Plated Layer: Kind of Plating | Plating Adherence | Unpainted Corrosion Resistance | Water Resistant Adherence | Post-painting Corrosion Resistance |
|---|---|---|---|---|---|---|---|---|---|
| 2C-1* | — | — | 1 | 20 | 12% Ni - balance Zn | x | x | Δ | x |
| 2* | — | — | 1 | 20 | 10% Fe - balance Zn | x | x | Δ | x |
| 3* | — | — | 1 | 20 | 10% Ni - balance Zn | x | x | Δ | x |
| 4 | Phosphate Film | 0.2 | 1 | 20 | 12% Ni - balance Zn | Δ | Δ | Δ | Δ |
| 5 | " | 2 | 1 | 60 | 10% Co - balance Zn | Δ | o | Δ | o |
| 6 | " | 20 | 1 | 40 | 10% Ni - 5% Fe - balance Zn | Δ | o | Δ | o |
| 7 | " | 0.5 | 1 | 20 | 10% Fe - balance Zn | Δ | Δ | Δ | Δ |
| 8 | " | 2 | 1 | 50 | 5% Cr - balance Zn | Δ | o | Δ | o |
| 9 | " | 20 | 1 | 40 | 20% Fe - 5% Co - balance Zn | Δ | o | Δ | o |
| 10 | " | 10 | 1 | 40 | 35% Mn - balance Zn | Δ | o | Δ | o |
| 11 | " | 100 | 1 | 20 | 10% Ni - balance Zn | Δ | o | Δ | o |
| 12 | " | 10 | 1 | 40 | 15% Ti - balance Zn | Δ | o | Δ | o |
| 13 | " | 100 | 1 | 80 | 50% Sn - balance Zn | Δ | o | Δ | o |
| 14 | " | 1 | 1 | 5 | 30% Cu - balance Zn | Δ | o | Δ | o |
| 2C-15 | Phosphate Film | 45 | 1 | 100 | 35% Cd - balance Zn | Δ | o | Δ | o |
| 16 | " | 7 | 1 | 30 | 10% Ni - 0.1% Cr - balance Zn | Δ | o | Δ | o |
| 17 | " | 65 | 1 | 60 | 18% Pb - balance Zn | Δ | o | Δ | o |
| 18 | " | 20 | 1 | 40 | 15% Fe - 1% Cr - balance Zn | Δ | o | Δ | o |
| 19 | " | 20 | 1 | 40 | 12% Ni - balance Zn | Δ | o | Δ | o |
| 20* | — | — | 2 | (Upper Layer) 5<br>(Lower Layer) 20 | 80% Fe - balance Zn<br>20% Fe - balance Zn | x | x | o | x |
| 21 | Phosphate Film | 20 | 2 | "<br>" | " | Δ | o | o | o |
| 22* | — | — | 3 | (Upper Layer) 5<br>(Middle Layer) 10<br>(Lower Layer) 20 | 15% Ni - balance Zn<br>9% Ni - balance Zn<br>3% Ni - balance Zn | x | x | Δ | x |
| 23 | Phosphate Film | 20 | 3 | " | " | Δ | o | Δ | o |
| 24* | — | — | Graded | 30 | (Uppermost Layer) 90% Fe - balance Zn<br>(Lowermost Layer) 5% Fe - balance Zn | x | x | o | x |
| 25 | Phosphate Film | 20 | Graded | 30 | " | Δ | o | o | o |
| 2C-26* | — | — | 2 | (Upper Layer) 20<br>(Lower Layer) 1 | 12% Ni - balance Zn<br>Ni | x~Δ | x | Δ | x |
| 27 | Phosphate Film | 20 | 2 | "<br>" | " | o | o | Δ | o |
| 28* | — | — | 2 | (Upper Layer) 20<br>(Lower Layer) 1 | 10% Fe - balance Zn<br>Co | x~Δ | x | Δ | x |
| 29 | Phosphate Film | 20 | 2 | " | " | o | o | Δ | o |

Remarks: *Comparative

TABLE 2 (D)

| Sample | Chemical Conversion Film: Kind of Film | Chemical Conversion Film: Deposition Amount ($mg/m^2$) | Plated Layer: Number of Layer(s) or Graded Layer | Plated Layer: Deposition Amount ($g/m^2$) | Plated Layer: Kind of Plating | Plating Adherence | Unpainted Corrosion Resistance | Water Resistant Adherence | Post-painting Corrosion Resistance |
|---|---|---|---|---|---|---|---|---|---|
| 2D-1* | — | — | 1 | 20 | 5% $SiO_2$ - 10% Ni - balance Zn | x | x | Δ | x |
| 2* | — | — | 1 | 20 | 5% $TiO_2$ - 10% Ni - balance Zn | x | x | Δ | x |
| 3* | — | — | 1 | 30 | 8% SiC - balance Zn | x | x | Δ | x |
| 4 | Phosphate Film | 0.2 | 1 | 20 | 5% $SiO_2$ - 10% Ni - balance Zn | Δ | Δ | Δ | Δ |
| 5 | " | 2 | 1 | 30 | " | Δ | o | Δ | o |
| 6 | " | 20 | 1 | 50 | 5% $Al_2O_3$ - 10% Co - balanace Zn | Δ | o | Δ | o |
| 7 | " | 0.5 | 1 | 20 | 5% $SiO_2$ - 10% Ni - balance Zn | Δ | Δ | Δ | Δ |
| 8 | " | 5 | 1 | 30 | " | Δ | o | Δ | o |
| 9 | " | 20 | 1 | 50 | 5% $ZrO_2$ - 10% Fe - balance Zn | Δ | o | Δ | o |
| 10 | " | 10 | 1 | 80 | 10% Cr particles - balance Zn | Δ | o | Δ | o |
| 2D-11 | Phosphate Film | 100 | 1 | 40 | 10% Al particles - balance Zn | Δ | o | Δ | o |
| 12 | " | 10 | 1 | 100 | 5% $PbCrO_4$ particles - balance Zn | Δ | o | Δ | o |
| 13 | " | 100 | 1 | 60 | 3% $SiO_2$ - 15% Fe - balance Zn | Δ | o | Δ | o |
| 14 | " | 1 | 1 | 10 | 2% $TiO_2$ - 15% Co - balance Zn | Δ | o | Δ | o |
| 15 | " | 45 | 1 | 5 | 15 $Al_2O_3$ - 10% Ni - balance Zn | Δ | o | Δ | o |
| 16 | " | 7 | 1 | 30 | 8% $ZrO_2$ - balance Zn | Δ | o | Δ | o |
| 17 | " | 65 | 1 | 20 | 5% $BaCrO_4$ - 10% Ni - balance Zn | Δ | o | Δ | o |
| 18 | " | 20 | 1 | 20 | " | Δ | o | Δ | o |
| 19* | — | — | 2 | (Upper Layer) 20 | 5% $SiO_2$ - 10% Ni - balance Zn | x | x | Δ | x |
| | | | | (Lower Layer) 5 | 10% Ni - balance Zn | Δ | o | Δ | o |
| 20 | Phosphate Film | 20 | 2 | " | " | | | | |
| 2D-21* | — | — | 2 | (Upper Layer) 5 | 80% Fe - balance Zn | x | x | o | x |
| | | | | (Lower Layer) 20 | 5% $TiO_2$ - 10% Fe - balance Zn | | | | |
| 22 | Phosphate Film | 20 | 2 | " | " | Δ | o | o | o |
| 23* | — | — | 3 | (Upper Layer) 5 | 80% Fe - balance Zn | | | | |
| | | | | (Middle Layer) 20 | 5% $Al_2O_3$ - 10% Ni - balance Zn | x | x | o | x |
| | | | | (Lower Layer) 20 | 10% Co - balance Zn | | | | |
| 24 | Phosphate Film | 20 | 3 | " | " | Δ | o | o | o |
| 25* | — | — | 3 | (Upper Layer) 5 | 80% Fe - balance Zn | x | x | o | x |
| | | | | (Middle Layer) 10 | Zn | | | | |
| | | | | (Lower Layer) 30 | 5% BaCrO - 10% Co - balance Zn | | | | |

TABLE 2 (D)-continued

| Sample | Chemical Conversion Film | | Plated Layer | | | Plating Adherence | Unpainted Corrosion Resistance | Water Resistant Adherence | Post-painting Corrosion Resistance |
|---|---|---|---|---|---|---|---|---|---|
| | Kind of Film | Deposition Amount ($mg/m^2$) | Number of Layer(s) or Graded Layer | Deposition Amount ($g/m^2$) | Kind of Plating | | | | |
| 26 | Phosphate Film | 20 | 3 | " | " | Δ | o | o | o |
| 27* | — | — | 2 | (Upper Layer) 20 | 5% $SiO_2$ - 10% Ni - balance Zn | x~Δ | x | Δ | x |
| | | | | (Lower Layer) 1 | Ni | | | | |
| 28 | Phosphate Film | 20 | 2 | " | " | o | o | Δ | o |

Remarks: *Comparative

EXAMPLE 2

The process of Example 1 was repeated, unless otherwise specified.

Tables 3(A) through 3(D) correspond to the preferred embodiment with a chemical conversion layer between the lower layer of the Zn-series alloy plating or Zn-series composite material and the upper Fe-series plated layer. Specifically, in Table 3(A), a layer structure with a chemical conversion, chromating layer, and a lower plated layer of Zn-series alloy; in Table 3(B), a layer structure with a chemical conversion, chromating layer, and a lower plated layer of Zn-series composite material; in Table 3(C), a layer structure with a chemical conversion, phosphating layer, and a lower plated layer of Zn-series alloy; and in FIG. 3(D), a layer structure with a chemical conversion, phosphating layer, and a lower plated layer of Zn-series composite material are shown.

In Tables 3(A), 3(B), 3(C), and 3(D) samples marked with an asterisk are comparative and the other samples are those of the present invention.

The comparative samples Nos. 1, 6, 10, 33, 37, and 39 of Table 3(A), Nos. 1, 6, and 10, 25 of Table 3(B), Nos. 1, 6, 10, 33, 37, and 39 of Table 3(C), and Nos. 1, 6, 10, and 25 of Table 3(D), do not have a chemical conversion film, and thus the plating adherence, unpainted corrosion resistance and the post-painting corrosion resistance, particularly red-rust resistance, are poor.

Contrary to this, the samples according to the present invention exhibit an improvement in any of the plating adherence, unpainted corrosion resistance, and post-painted corrosion resistance (Δ and o marks). The samples 2, 30, and 35 in Tables 3(A), and 3(C), and sample 2 in Tables 3(B) and 3(D) have a small deposition amount of the chemical conversion layer and, therefore, exhibit a poorer corrosion resistance (Δ mark and the like) than the other samples according to the present invention. The sample 21 in Tables 3(A) and (C) and sample 14 in Tables 3(B) and (D) have a small deposition amount of the lower plated layer and, therefore, exhibit a poorer post-painting corrosion resistance than the other samples according to the present invention. The sample 24 in Tables 3(A) and (C) has only a small amount of alloying element in the lower plated layer and, therefore, exhibits a poorer post-painting corrosion resistance than the other samples according to the present invention. The sample 26 in Tables 3(A) and (C), and the sample 17 in Tables 3(B) and 3(D) have a small deposition amount of the upper plated layer and, therefore, exhibit a poorer water resistant adherence than the other samples according to the present invention. The samples 30 and 31 in Tables 3(A) and (C), and the sample 21 in Tables 3(B) and 3(D) have a small Fe content of the upper plated layer and, therefore, exhibit a poorer water resistance adherence than the other samples according to the present invention.

TABLE 3 (A)

| | First Layer | | | | | | | | | | | | Chemical Conversion Film | | | Second Film Concentration of Element(s) other than Fe (wt %) | | | | | | |
|---|---|---|---|---|---|---|---|---|---|---|---|---|---|---|---|---|---|---|---|---|---|---|
| | Morphology of | Deposition Amount | Concentration of Element(s) other than Zn (wt %) | | | | | | | | | | | Deposition Amount | Deposition Amount | | | | Plating | Unpainted Corrosion | Water-resistant | Post-painting Corrosion |
| No. | Layer | ($g/m^2$) | Fe | Ni | Co | Cr | Mn | Ti | Sn | Cu | Cd | Pb | Kind | ($mg/m^2$) | ($g/m^2$) | Zn | Cr | P | Adherence | Resistance | Adherence | Resistance |
| 3A-1* | Single Layer | 20 | — | 11 | 0.3 | — | — | — | — | — | — | — | — | — | 3 | 29 | 0.5 | — | x | x | o | x |
| 2 | " | 20 | — | 11 | 0.3 | — | — | — | — | — | — | — | Chromate Film | 0.5 | 3 | 29 | 0.5 | — | Δ | Δ | o | Δ |
| 3 | " | 20 | — | 11 | 0.3 | — | — | — | — | — | — | — | " | 1 | 3 | 29 | 0.5 | — | Δ | o | o | o |
| 4 | " | 20 | — | 11 | 0.3 | — | — | — | — | — | — | — | " | 50 | 3 | 29 | 0.5 | Δ | o | o | o | |
| 5 | " | 20 | — | 11 | 0.3 | — | — | — | — | — | — | — | " | 100 | 3 | 29 | 0.5 | — | Δ | o | o | o |
| 6* | " | 20 | 20 | — | — | — | — | — | — | — | — | — | — | — | 2 | 20 | — | — | x | x | o | x |
| 7 | " | 20 | 20 | — | — | — | — | — | — | — | — | — | Chromate Film | 2 | 2 | 25 | — | — | Δ | o | o | o |
| 8 | " | 20 | 20 | — | — | — | — | — | — | — | — | — | " | 20 | 2 | 15 | — | — | Δ | o | o | o |
| 9 | " | 20 | 20 | — | — | — | — | — | — | — | — | — | " | 20 | 2 | 1 | — | — | Δ | o | o | o |
| 10* | " | 20 | — | 12 | — | — | — | — | — | — | — | — | — | — | 5 | — | — | 0.1 | x | x | o | x |
| 11 | " | 20 | — | 12 | — | — | — | — | — | — | — | — | Chromate Film | 3 | 5 | — | — | 1 | Δ | o | o | o |
| 12 | " | 20 | — | 12 | — | — | — | — | — | — | — | — | " | 30 | 5 | — | — | 0.1 | Δ | o | o | o |
| 13 | " | 20 | — | 30 | — | — | — | — | — | — | — | — | " | 30 | 5 | — | — | 0.1 | Δ | o | o | o |
| 3A-14 | Single Layer | 20 | — | — | — | 3 | — | — | — | — | — | — | Chromate Film | 10 | 3 | 10 | 0.1 | — | Δ | o | o | o |
| 15 | " | 20 | — | — | — | — | 20 | — | — | — | — | — | " | 10 | 3 | 10 | — | — | Δ | o | o | o |
| 16 | " | 20 | — | — | — | — | — | 5 | — | — | — | — | " | 10 | 3 | — | — | 30 | Δ | o | o | o |
| 17 | " | 20 | — | — | — | — | — | — | 15 | — | — | — | " | 10 | 3 | 10 | 0.1 | — | Δ | o | o | o |
| 18 | " | 20 | — | — | — | — | — | — | — | 8 | — | — | " | 10 | 3 | 10 | — | — | Δ | o | o | o |
| 19 | " | 20 | — | — | — | — | — | — | — | — | 7 | — | " | 10 | 3 | — | — | 30 | Δ | o | o | o |
| 20 | " | 20 | — | — | — | — | — | — | — | — | — | 17 | " | 10 | 3 | 10 | 0.1 | — | Δ | o | o | o |
| 21 | " | 3 | 1 | 12 | — | — | — | — | — | — | — | — | " | 20 | 4 | 25 | 1 | — | Δ | o | o | o |
| 22 | " | 5 | 1 | 12 | — | — | — | — | — | — | — | — | " | 20 | 4 | 25 | 1 | — | Δ | o | o | o |
| 23 | " | 20 | 1 | 12 | — | — | — | — | — | — | — | — | " | 20 | 4 | 25 | 1 | — | Δ | o | o | o |
| 24 | " | 20 | — | 0.5 | — | 0.5 | — | — | — | — | — | — | " | 80 | 4 | 3 | — | — | Δ | o | o | Δ |
| 25 | " | 20 | — | 2.5 | — | 0.5 | — | — | — | — | — | — | " | 80 | 4 | 3 | — | — | Δ | o | o | o |
| 26 | " | 20 | 15 | — | 1 | — | — | — | — | — | — | — | " | 40 | 0.5 | — | — | 10 | Δ | o | Δ | o |
| 27 | " | 20 | 15 | — | 1 | — | — | — | — | — | — | — | " | 40 | 1 | — | — | 10 | Δ | o | o | o |
| 28 | " | 20 | 2 | 11 | — | 0.1 | — | — | — | — | — | — | " | 20 | 3 | 2 | 0.01 | — | Δ | o | o | o |

TABLE 3(A)-2

| | First Layer | | | | | | | | | | | | Chemical Conversion Film | | | Second Film Concentration of Element(s) other than Fe (wt %) | | | | | | |
|---|---|---|---|---|---|---|---|---|---|---|---|---|---|---|---|---|---|---|---|---|---|---|
| | Morphology of Layer | Deposition Amount | Concentration of Element(s) other than Zn (wt %) | | | | | | | | | | | Deposition Amount | Deposition Amount | | | | Plating Adherence | Unpainted Corrosion Resistance | Water-resistant Adherence | Post-painting Corrosion Resistance |
| No. | | ($g/m^2$) | Fe | Ni | Co | Cr | Mn | Ti | Sn | Cu | Cd | Pb | Kind | ($mg/m^2$) | ($g/m^2$) | Zn | Cr | P | | | | |
| 3A-29 | Single Layer | 20 | 2 | 11 | — | 0.1 | — | — | — | — | — | — | Chromate Film | 20 | 3 | 5 | 0.1 | — | Δ | o | o | o |
| 30 | " | 20 | 2 | 5 | 1 | 0.1 | 2 | 0.1 | 2 | 2 | 2 | 2 | " | 0.1 | 3 | 40 | — | — | Δ | Δ | Δ | Δ |
| 31 | " | 20 | 2 | 5 | 1 | 0.1 | 2 | 0.1 | 2 | 2 | 2 | 2 | " | 5 | 3 | 40 | — | — | Δ | o | Δ | o |
| 32 | " | 20 | 2 | 5 | 1 | 0.1 | 2 | 0.1 | 2 | 2 | 2 | 2 | " | 5 | 3 | 30 | — | — | Δ | o | o | o |
| 33* | Two Layers(1) | 5 | 18 | — | — | 0.2 | — | 1 | — | — | — | — | — | — | 2 | — | — | 0.01 | x | x | o | x |
| | | 20 | 5 | — | — | — | — | — | — | — | — | — | | | | — | — | — | | | | |
| 34 | | 5 | 18 | — | — | 0.2 | — | 1 | — | — | — | — | Chromate Film | 5 | 2 | — | — | 0.01 | Δ | o | o | o |
| | | 20 | 5 | — | — | — | — | — | — | — | — | — | | | | — | — | — | | | | |
| 35 | " | 15 | — | 19 | 1 | — | — | — | — | — | — | — | " | 0.3 | 4 | 20 | 0.3 | — | Δ | Δ | o | Δ |
| | | 15 | — | 7 | — | — | — | — | — | — | — | — | | | | — | — | — | | | | |
| 36 | " | 15 | — | 19 | 1 | — | — | — | — | — | — | — | " | 5 | 4 | 20 | 0.3 | — | Δ | o | o | o |
| | | 15 | — | 7 | — | — | — | — | — | — | — | — | | | | — | — | — | | | | |
| 37* | Three Layers(2) | 10 | — | — | — | — | 10 | — | — | — | — | — | — | — | 3 | 5 | — | — | x | x | o | x |
| | | 10 | — | 10 | — | — | — | — | — | — | — | — | | | | — | — | — | | | | |
| | | 10 | — | — | — | — | — | — | — | 10 | — | — | | | | — | — | — | | | | |
| 38 | " | 10 | — | — | — | — | 10 | — | — | — | — | — | Chromate Film | 15 | 3 | 5 | — | — | Δ | o | o | o |
| | | 10 | — | 10 | — | — | — | — | — | — | — | — | | | | — | — | — | | | | |
| | | 10 | — | — | — | — | — | — | — | 10 | — | — | | | | — | — | — | | | | |
| 39* | Graded Layers(3) | 20 | 20 | — | — | — | — | — | — | — | — | — | — | — | 1 | — | — | 20 | x | x | o | x |
| | | | 3 | — | — | — | — | — | — | — | — | — | | | | — | — | — | | | | |
| 40 | " | 20 | 20 | — | — | — | — | — | — | — | — | — | Chromate Film | 10 | 1 | — | — | 20 | Δ | o | o | o |
| | | | 3 | — | — | — | — | — | — | — | — | — | | | | — | — | — | | | | |

TABLE 3 (B)

| No. | First Layer: Concentration of Element(s) other other than Zn (wt %) | First Layer: Particles | First Layer: Deposition Amount ($g/m^2$) | Chemical Conversion Film: Kind | Chemical Conversion Film: Deposition Amount ($mg/m^2$) | Chemical Conversion Film: Deposition Amount (mg/m) | Second Film: Concentration of Element(s) other than Fe (wt %): Zn | Second Film: Cr | Second Film: P | Evaluation: Plating Adherence | Evaluation: Unpainted Corrosion Resistance | Evaluation: Water-resistant Adherence | Evaluation: Post-painting Corrosion Resistance |
|---|---|---|---|---|---|---|---|---|---|---|---|---|---|
| 3B-1* | 11% Ni - 0.3% Co | 3% $SiO_2$ | 20 | — | — | 3 | 29 | 0.5 | — | x | x | o | x |
| 2 | 11% Ni - 0.3% Co | 3% $SiO_2$ | 20 | Chromate Film | 0.5 | 3 | 29 | 0.5 | — | Δ | Δ | o | Δ |
| 3 | 11% Ni - 0.3% Co | 3% $SiO_2$ | 20 | " | 1 | 3 | 29 | 0.5 | — | Δ | o | o | o |
| 4 | 11% Ni - 0.3% Co | 3% $SiO_2$ | 20 | " | 50 | 3 | 29 | 0.5 | — | Δ | o | o | o |
| 5 | 11% Ni - 0.3% Co | 3% $SiO_2$ | 20 | " | 100 | 3 | 29 | 0.5 | — | Δ | o | o | o |
| 6* | 15% Fe | 5% $SiO_2$ | 20 | — | — | 2 | 20 | — | — | x | x | o | x |
| 7 | 15% Fe | 5% $SiO_2$ | 20 | Chromate Film | 2 | 2 | 25 | — | — | Δ | o | o | o |
| 8 | 15% Fe | 5% $SiO_2$ | 20 | " | 20 | 2 | 15 | — | — | Δ | o | o | o |
| 9 | 15% Fe | 5% $SiO_2$ | 20 | " | 20 | 2 | 1 | — | — | Δ | o | o | o |
| 10* | 12% Ni | 2% $BaCrO_4$ | 20 | — | — | 5 | — | — | 0.1 | x | x | o | x |
| 11 | 12% Ni | 2% $BaCrO_4$ | 20 | Chromate Film | 3 | 5 | — | — | 1 | Δ | o | o | o |
| 12 | 12% Ni | 2% $BaCrO_4$ | 20 | " | 30 | 5 | — | — | 0.1 | Δ | o | o | o |
| 3B-13 | 12% Ni | 2% $BaCrO_4$ | 20 | Chromate Film | 30 | 5 | — | — | 0.1 | Δ | o | o | o |
| 14 | 1% Fe - 12% Ni | 5% $TiO_2$ | 3 | " | 20 | 4 | 25 | 1 | — | Δ | o | o | o |
| 15 | 1% Fe - 12% Ni | 5% $TiO_2$ | 5 | " | 20 | 4 | 25 | 1 | — | Δ | o | o | o |
| 16 | 1% Fe - 12% Ni | 5% $TiO_2$ | 20 | " | 20 | 4 | 25 | 1 | — | Δ | o | o | o |
| 17 | 15% Fe - 1% Co | 5% $ZrO_2$ | 20 | " | 40 | 0.5 | — | — | 10 | Δ | o | Δ | o |
| 18 | 15% Fe - 1% Co | 5% $ZrO_2$ | 20 | " | 40 | 1 | — | — | 10 | Δ | o | o | o |
| 19 | 2% Fe - 11% Ni - 0.1% Cr | | 20 | " | 20 | 3 | 2 | 0.01 | — | Δ | o | o | o |
| 20 | 2% Fe - 11% Ni - 0.1% Cr | | 20 | " | 20 | 3 | 5 | 0.1 | — | Δ | o | o | o |
| 21 | 5% Co - 0.1% Cr | 3% $Al_2O_3$ | 20 | " | 5 | 3 | 40 | — | — | Δ | o | Δ | o |
| 22 | 5% Co - 0.1% Cr | 3% $Al_2O_3$ | 20 | " | 5 | 3 | 30 | — | — | Δ | o | o | o |
| 23 | 10% Ni | 1% graphite | 20 | " | 3 | 3 | 10 | — | — | Δ | o | o | o |
| 24 | 20% Fe | 1% Cr | 20 | " | 3 | 3 | 10 | — | — | Δ | o | o | o |
| 25* | Zn | 3% Al | 20 | — | — | 3 | 10 | — | — | Δ | x | o | x |
| 26 | " | " | 20 | Chromate Film | 5 | 3 | 10 | — | — | Δ | o | o | o |

TABLE 3 (C)

| | First Layer | | | | | | | | | | | | Chemical Conversion Film | | | Second Film Concentration of Element(s) other than Fe (wt %) | | | | | | |
|---|---|---|---|---|---|---|---|---|---|---|---|---|---|---|---|---|---|---|---|---|---|---|
| | Morphology of | Deposition Amount | Concentration of Element(s) other than Zn (wt %) | | | | | | | | | | | Deposition Amount | Deposition Amount | | | | Plating | Unpainted Corrosion | Water-resistant | Post-painting Corrosion Resist- |
| No. | Layer | (g/m²) | Fe | Ni | Co | Cr | Mn | Ti | Sn | Cu | Cd | Pb | Kind | (mg/m²) | (g/m²) | Zn | Cr | P | Adherence | Resistance | Adherence | ance |
| 3C-1* | Single Layer | 20 | — | 11 | 0.3 | — | — | — | — | — | — | — | — | — | 3 | 29 | 0.5 | — | x | x | o | x |
| 2 | " | 20 | — | 11 | 0.3 | — | — | — | — | — | — | — | Phosphate Film | 0.5 | 3 | 29 | 0.5 | — | Δ | Δ | o | Δ |
| 3 | " | 20 | — | 11 | 0.3 | — | — | — | — | — | — | — | " | 1 | 3 | 29 | 0.5 | — | Δ | o | o | o |
| 4 | " | 20 | — | 11 | 0.3 | — | — | — | — | — | — | — | " | 50 | 3 | 29 | 0.5 | — | Δ | o | o | o |
| 5 | " | 20 | — | 11 | 0.3 | — | — | — | — | — | — | — | " | 100 | 3 | 29 | 0.5 | — | Δ | o | o | o |
| 6* | " | 20 | 20 | — | — | — | — | — | — | — | — | — | — | — | 2 | 20 | — | — | x | x | o | x |
| 7 | " | 20 | 20 | — | — | — | — | — | — | — | — | — | Phosphate Film | 2 | 2 | 25 | — | — | Δ | o | o | o |
| 8 | " | 20 | 20 | — | — | — | — | — | — | — | — | — | " | 20 | 2 | 15 | — | — | Δ | o | o | o |
| 9 | " | 20 | 20 | — | — | — | — | — | — | — | — | — | " | 20 | 2 | 1 | — | — | Δ | o | o | o |
| 10* | " | 20 | — | 12 | — | — | — | — | — | — | — | — | — | — | 5 | — | — | 0.1 | x | x | o | x |
| 11 | " | 20 | — | 12 | — | — | — | — | — | — | — | — | Phosphate Film | 3 | 5 | — | — | 1 | Δ | o | o | o |
| 12 | " | 20 | — | 12 | — | — | — | — | — | — | — | — | " | 30 | 5 | — | — | 0.1 | Δ | o | o | o |
| 13 | " | 20 | — | 30 | — | — | — | — | — | — | — | — | " | 30 | 5 | — | — | 0.1 | Δ | o | o | o |
| 3C-14 | Single Layer | 20 | — | — | — | 3 | — | — | — | — | — | — | Phosphate Film | 10 | 3 | 10 | 0.1 | — | Δ | o | o | o |
| 15 | " | 20 | — | — | — | — | 20 | — | — | — | — | — | " | 10 | 3 | 10 | — | — | Δ | o | o | o |
| 16 | " | 20 | — | — | — | — | — | 5 | — | — | — | — | " | 10 | 3 | — | — | 30 | Δ | o | o | o |
| 17 | " | 20 | — | — | — | — | — | — | 15 | — | — | — | " | 10 | 3 | 10 | 0.1 | — | Δ | o | o | o |
| 18 | " | 20 | — | — | — | — | — | — | — | 8 | — | — | " | 10 | 3 | 10 | — | — | Δ | o | o | o |
| 19 | " | 20 | — | — | — | — | — | — | — | — | 7 | — | " | 10 | 3 | — | — | 30 | Δ | o | o | o |
| 20 | " | 20 | — | — | — | — | — | — | — | — | — | 17 | " | 10 | 3 | 10 | 0.1 | — | Δ | o | o | o |
| 21 | " | 3 | 1 | 12 | — | — | — | — | — | — | — | — | " | 20 | 4 | 25 | 1 | — | Δ | o | o | Δ |
| 22 | " | 5 | 1 | 12 | — | — | — | — | — | — | — | — | " | 20 | 4 | 25 | 1 | — | Δ | o | o | o |
| 23 | " | 20 | 1 | 12 | — | — | — | — | — | — | — | — | " | 20 | 4 | 25 | 1 | — | Δ | o | o | o |
| 24 | " | 20 | — | 0.5 | — | 0.5 | — | — | — | — | — | — | " | 80 | 4 | 3 | — | — | Δ | o | o | o |
| 25 | " | 20 | — | 2.5 | — | 0.5 | — | — | — | — | — | — | " | 80 | 4 | 3 | — | — | Δ | o | o | o |
| 26 | " | 20 | 15 | — | 1 | — | — | — | — | — | — | — | " | 40 | 0.5 | — | — | 10 | Δ | o | Δ | o |
| 27 | " | 20 | 15 | — | 1 | — | — | — | — | — | — | — | " | 1 | — | — | 10 | Δ | o | o | o | |
| 28 | " | 20 | 2 | 11 | — | 0.1 | — | — | — | — | — | — | " | 20 | 3 | 2 | 0.01 | — | Δ | o | o | o |

TABLE 3(C)-2

| No. | First Layer: Morphology of Layer | First Layer: Deposition Amount (g/m²) | Concentration of Element(s) other than Zn (wt %): Fe | Ni | Co | Cr | Mn | Ti | Sn | Cu | Cd | Pb | Chemical Conversion Film: Kind | Deposition Amount (mg/m²) | Deposition Amount (g/m²) | Second Film Concentration of Element(s) other than Fe (wt %): Zn | Cr | P | Plating Adherence | Unpainted Corrosion Resistance | Water-Resistance Adherence | Post-painting Corrosion resistance |
|---|---|---|---|---|---|---|---|---|---|---|---|---|---|---|---|---|---|---|---|---|---|---|
| 3C-29 | Single Layer(1) | 20 | 2 | 11 | — | 0.1 | — | — | — | — | — | — | Phosphate Film | 20 | 3 | 5 | 0.1 | — | Δ | o | o | o |
| 30 | " | 20 | 2 | 5 | 1 | 0.1 | 2 | 0.1 | 2 | 2 | 2 | 2 | " | 0.1 | 3 | 40 | — | — | Δ | Δ | Δ | Δ |
| 31 | " | 20 | 2 | 5 | 1 | 0.1 | 2 | 0.1 | 2 | 2 | 2 | 2 | " | 5 | 3 | 40 | — | — | Δ | o | Δ | o |
| 32 | " | 20 | 2 | 5 | 1 | 0.1 | 2 | 0.1 | 2 | 2 | 2 | 2 | " | 5 | 3 | 30 | — | — | Δ | o | o | o |
| 33* | Two Layers(1) | 5 | 18 | — | — | 0.2 | — | 1 | — | — | — | — | — | — | 2 | — | — | 0.01 | x | x | o | x |
| | | 20 | 5 | — | — | — | — | — | — | — | — | — | | | | — | — | — | | | | |
| 34 | | 5 | 18 | — | — | 0.2 | — | 1 | — | — | — | — | Phosphate Film | 50 | 2 | — | — | 0.01 | Δ | o | o | o |
| | | 20 | 5 | — | — | — | — | — | — | — | — | — | | | | — | — | — | | | | |
| 35 | " | 15 | — | 19 | 1 | — | — | — | — | — | — | — | " | 0.3 | 4 | 20 | 0.3 | — | Δ | Δ | o | Δ |
| | | 15 | — | 7 | — | — | — | — | — | — | — | — | | | | — | — | — | | | | |
| 36 | " | 15 | — | · | 1 | — | — | — | — | — | — | — | " | 50 | 4 | 20 | 0.3 | — | Δ | o | o | o |
| | | 15 | — | 7 | — | — | — | — | — | — | — | — | | | | — | — | — | | | | |
| 37* | Three Layers(2) | 10 | — | — | — | — | 10 | — | — | — | — | — | — | — | 3 | 5 | — | — | x | x | o | x |
| | | 10 | — | 10 | — | — | — | — | — | — | — | — | | | | — | — | — | | | | |
| | | 10 | — | — | — | — | — | — | — | 10 | — | — | | | | — | — | — | | | | |
| 38 | " | 10 | — | — | — | — | 10 | — | — | — | — | — | Phosphate Film | 40 | 3 | 5 | — | — | Δ | o | o | o |
| | | 10 | — | 10 | — | — | — | — | — | — | — | — | | | | — | — | — | | | | |
| | | 10 | — | — | — | — | — | — | — | 10 | — | — | | | | — | — | — | | | | |
| 39* | Graded Layers(3) | 20 | 20 | — | — | — | — | — | — | — | — | — | — | — | 1 | — | — | 20 | x | x | o | x |
| | | | 3 | — | — | — | — | — | — | — | — | — | | | | — | — | — | | | | |
| 40 | " | 20 | 20 | — | — | — | — | — | — | — | — | — | Phosphate Film | 30 | 1 | — | — | 20 | Δ | o | o | o |
| | | | 3 | — | — | — | — | — | — | — | — | — | | | | | | | | | | |

TABLE 3 (D)

| | First Layer | | | Chemical Conversion Film | | | Second Film | | | Evaluation | | | |
|---|---|---|---|---|---|---|---|---|---|---|---|---|---|
| | Concentration of Element(s) other other than Zn (wt %) | | Deposition Amount | | Deposition Amount | Deposition Amount | Concentration of Element(s) other than Fe (wt %) | | | Plating | Unpainted Corrosion | Water-resistant | Post-painting Corrosion Resist- |
| No. | | Particles | ($g/m^2$) | Kind | ($mg/m^2$) | (mg/m) | Zn | Cr | P | Adherence | Resistance | Adherence | ance |
| 3D-1* | 11% Ni - 0.3% Co | 3% $SiO_2$ | 20 | Phosphate Film | 0 | 3 | 29 | 0.5 | — | x | x | o | x |
| 2 | 11% Ni - 0.3% Co | 3% $SiO_2$ | 20 | " | 0.5 | 3 | 29 | 0.5 | — | Δ | Δ | o | Δ |
| 3 | 11% Ni - 0.3% Co | 3% $SiO_2$ | 20 | " | 1 | 3 | 29 | 0.5 | — | Δ | o | o | o |
| 4 | 11% Ni - 0.3% Co | 3% $SiO_2$ | 20 | " | 50 | 3 | 29 | 0.5 | — | Δ | o | o | o |
| 5 | 11% Ni - 0.3% Co | 3% $SiO_2$ | 20 | " | 100 | 3 | 29 | 0.5 | — | Δ | o | o | o |
| 6* | 15% Fe | 5% $SiO_2$ | 20 | " | 0 | 2 | 20 | — | — | x | x | o | x |
| 7 | 15% Fe | 5% $SiO_2$ | 20 | " | 2 | 2 | 25 | — | — | Δ | o | o | o |
| 8 | 15% Fe | 5% $SiO_2$ | 20 | " | 20 | 2 | 15 | — | — | Δ | o | o | o |
| 9 | 15% Fe | 5% $SiO_2$ | 20 | " | 20 | 2 | 1 | — | — | Δ | o | o | o |
| 10* | 12% Ni | 2% $BaCrO_4$ | 20 | " | 0 | 5 | — | — | 0.1 | x | x | o | x |
| 11 | 12% Ni | 2% $BaCrO_4$ | 20 | " | 3 | 5 | — | — | 1 | Δ | o | o | o |
| 12 | 12% Ni | 2% $BaCrO_4$ | 20 | " | 30 | 5 | — | — | 0.1 | Δ | o | o | o |
| 13 | 12% Ni | 2% $BaCrO_4$ | 20 | " | 30 | 5 | — | — | 0.1 | Δ | o | o | o |
| 3D-14 | 1% Fe - 12% Ni | 5% $TiO_2$ | 3 | Phosphate Film | 20 | 4 | 25 | 1 | — | Δ | o | o | 0 |
| 15 | 1% Fe - 12% Ni | 5% $TiO_2$ | 5 | " | 20 | 4 | 25 | 1 | — | Δ | o | o | o |
| 16 | 1% Fe - 12% Ni | 5% $TiO_2$ | 20 | " | 20 | 4 | 25 | 1 | — | Δ | o | o | o |
| 17 | 15% Fe - 1% Co | 5% $ZrO_2$ | 20 | " | 40 | 0.5 | — | — | 10 | Δ | o | Δ | o |
| 18 | 15% Fe - 1% Co | 5% $ZrO_2$ | 20 | " | 40 | 1 | — | — | 10 | Δ | o | o | o |
| 19 | 2% Fe - 11% Ni - 0.1% C | 1% $PbCrO_4$ | 20 | " | 20 | 3 | 2 | 0.01 | — | Δ | o | o | o |
| 20 | 2% Fe - 11% Ni - 0.1% Cr | 1% $PbCrO_4$ | 20 | " | 20 | 3 | 5 | 0.1 | — | Δ | o | o | o |
| 21 | 5% Co - 0.1% Cr | 3% $Al_2O_3$ | 20 | " | 5 | 3 | 40 | — | — | Δ | o | Δ | o |
| 22 | 5% Co - 0.1% Cr | 3% $Al_2O_3$ | 20 | " | 5 | 3 | 30 | — | — | Δ | o | o | o |
| 23 | 10% Ni | 1% graphite | 20 | " | 3 | 3 | 10 | — | — | Δ | o | o | o |
| 24 | 20% Fe | 1% Cr | 20 | " | 3 | 3 | 10 | — | — | Δ | o | o | o |
| 25* | Zn | 3% Al | 20 | — | — | 3 | 10 | — | — | Δ | x | o | x |
| 26 | " | " | 20 | Phosphate Film | 5 | 3 | 10 | — | — | Δ | o | o | o |

EXAMPLE 3

The process of Example 1 was repeated, unless otherwise specified.

Tables 4(A) through 4(E) correspond to the preferred embodiment of the layer structure, that is, the first, Fe, Ni, or Co plated layer, the second plated layer of Zn-series alloy or Zn-series composite material, the third, Fe-series plated layer, and the chemical conversion layer between the second and third plated layers.

In Table 4(A), the Zn-series electroplated layers are shown with regard to the examples of the second plated layer of Zn-Ni-Fe-Co alloy and the third plated layer of Fe-Cr-Cr alloy.

In Table 4(B), the Zn-series electroplated layers are shown with regard to the examples of the second plated layer of Zn-Ni-Co alloy and the third plated layer of Fe-Zn alloy.

In Table 4(C), the Zn-series electroplated layers are shown with regard to the examples of the second plated layer of Zn-Ni-Co alloy and the third plated layer of Fe-P alloy.

In Table 4(D), the Zn-series electroplated layers are shown with regard to the examples of the second plated layer of Zn-Ni-Fe-Co alloy and the third plated layer of Fe-Zn, Fe-Zn-Cr, or Fe-P alloy.

In Table 4(E), the Zn-series electroplated layers are shown with regard to the examples of the second plated layer of various Zn composite alloys.

The comparative samples Nos. 4A-1,4B-1, 4C-1, and 4E-1 do not have the first and third plating layers and a chemical conversion layer.

The comparative samples Nos. 4A-2, 4B-2, 4C-2, and 4E-2 do not have the first plated layer and a chemical conversion layer.

The comparative samples Nos. 4A-3, 4B-3, 4C-3, and 4E-3 do not have the third plated layer and a chemical conversion layer.

The other comparative samples do not have a chemical conversion layer.

In these comparative samples, the evaluation of the unpainted- and post-corrosion resistances are poor.

Contrary to this, the samples according to the present invention exhibit an improvement in any of the plating adherence, unpainted corrosion resistance, and post-painted corrosion resistance (Δ and o marks). The samples 10, 11, 12, and 13 in Tables 4(A), 4(B), and 4(C), and samples 1 and 2 in Tables 4(D), and samples 9, 10, 11, and 12 in Table 4(E) have a small deposition amount of the chemical conversion layer and, therefore, exhibit a poorer corrosion resistance (Δ mark and the like) than the other samples according to the present invention.

TABLE 4 (A)

| | | Plating Layer | | | | Second Plating Layer | | | | | Chemical Conversion Film | | Third Plating Layer | | | | Evaluation | | | |
|---|---|---|---|---|---|---|---|---|---|---|---|---|---|---|---|---|---|---|---|---|
| | | Deposition Amount | Concentration (wt %) | | | Concentration Gradient | sition Amount (wt %) | Concentration of Element(s) other than Zn | | | Deposition Amount | | Deposition Amount | Concentration of Element(s) other than Fe (wt %) | | | Plating Adherence | Unpainted Corrosion Resistance | Water Resistant Adherence | Post painting Corrosion Resistance |
| | No. | (g/m²) | Fe | Ni | Co | of Layer | (g/m²) | Fe | Ni | Co | mg/m² | Kind | g/m² | Zn | Cr | P | | | | |
| Comparative | 4A-1 | — | — | — | — | Uniform | 20 | 0.1 | 12 | 0.2 | — | — | — | — | — | — | x | x | Δ | x |
| | −2 | — | — | — | — | " | 20 | 0.1 | 12 | 0.3 | — | — | 3.0 | 25 | 1 | 0 | x | x | o | x |
| | −3 | 0.1 | 0 | 0 | 100 | " | 20 | 0.1 | 9 | 0.1 | — | — | — | — | — | — | x~Δ | x | Δ | x |
| | −4 | 0.01 | 0 | 0 | 100 | " | 30 | 0.1 | 8 | 0.2 | — | — | 0.5 | 20 | 0.8 | 0 | x~Δ | x | Δ | x |
| | −5 | 0.001 | 0 | 0 | 100 | " | 10 | 0.1 | 15 | 0.5 | — | — | 2.0 | 15 | 0.6 | 0 | x~Δ | x | o | x |
| | −6 | 0.2 | 0 | 0 | 100 | " | 3 | 0.1 | 13 | 1.0 | — | — | 2.0 | 18 | 0.7 | 0 | x~Δ | x | o | x |
| | −7 | 0.3 | 0 | 0 | 100 | " | 15 | 0.1 | 10 | 2.0 | — | — | 0.2 | 5 | 0.5 | 0 | x~Δ | x | Δ | x |
| | −8 | 0.05 | 0 | 0 | 100 | " | 30 | 0.1 | 20 | 10.0 | — | — | 5.0 | 13 | 1.0 | 0 | x~Δ | x | o | x |
| | −9 | 0.08 | 0 | 0 | 100 | " | 40 | 0.1 | 2 | 0.5 | — | — | 4.0 | 20 | 0.9 | 0 | x~Δ | x | o | x |
| Invention | −10 | 2.0 | 0 | 0 | 100 | " | 50 | 0.1 | 13 | 1.0 | 0.05 | Chromate Film | 2.0 | 25 | 5.0 | 0 | o | Δ | o | Δ |
| | −11 | 1.5 | 0 | 0 | 100 | " | 20 | 0.1 | 12 | 0.1 | 0.08 | Phosphate Film | 10.0 | 2 | 0.05 | 0 | o | Δ | o | Δ |
| Invention | 4A-12 | 0.03 | 0 | 0 | 100 | Uniform | 10 | 0.1 | 6 | 0.2 | 0.15 | Phosphate Film | 1.0 | 20 | 0.3 | 0 | o | Δ | o | Δ |
| | −13 | 2.0 | 0 | 0 | 100 | Uniform | 20 | 0.1 | 10 | 0.3 | 0.45 | " | 5.0 | 25 | 0.1 | 0 | o | Δ | o | Δ |
| | −14 | 0.15 | 0 | 0 | 100 | — | 30 | 0.1 | 12 | 0.1 | 95.0 | Chromate | 3.0 | 17 | 0.7 | 0 | o | o | o | o |
| | −Film | | | | | | | | | | | | | | | | | | | |
| | −15 | 0.2 | 0 | 0 | 100 | — | 25 | 0.1 | 4 | 0.2 | 16.0 | Phosphate Film | 2.0 | 4 | 0.9 | 0 | o | o | o | o |
| | −16 | 0.18 | 0 | 0 | 100 | — | 15 | 0.1 | 19 | 0.5 | 80.5 | " | 4.0 | 29 | 0.2 | 0 | o | o | o | o |
| | −17 | 0.4 | 0 | 0 | 100 | — | 6 | 0.1 | 11 | 0.2 | 12.0 | Chromate Film | 2.0 | 15 | 1.0 | 0 | o | o | o | o |
| | −18 | 0.5 | 0 | 100 | 0 | — | 40 | 0.1 | 8 | 0.1 | 73.4 | Phosphate Film | 1.5 | 18 | 0.6 | 0 | o | o | o | o |
| | −19 | 1.0 | 100 | 0 | 0 | — | 10 | 0.1 | 14 | 0.2 | 25.0 | " | 3.0 | 20 | 0.2 | 0 | o | o | o | o |
| | −20 | 1.2 | 0 | 98 | 2 | — | 15 | 0.1 | 9 | 0.1 | 34.3 | Chromate Film | 2.0 | 9 | 0.5 | 0 | o | o | o | o |
| | −21 | 0.7 | 2 | 98 | 0 | — | 20 | 0.1 | 17 | 0.4 | 28.4 | " | 2.0 | 18 | 0 | o | o | o | o | |
| | −22 | 0.6 | 1 | 98 | 1 | — | 20 | 0.1 | 12 | 0.5 | 41.3 | " | 1.5 | 24 | 0.3 | 0 | o | o | o | o |
| | −23 | 0.8 | 0 | 0 | 100 | Graded | 30 | 0.1 | *6 | 0.5 | 45.0 | " | 3.5 | 12 | 0.1 | 0 | o | o | o | o |
| | | | | | | | | *8 | 0.1 | | | | | | | | | | | |

TABLE 4 (B)

| | No. | First Plating Layer: Deposition Amount (g/m²) | First Plating Layer: Concentration (wt %) Fe | Ni | Co | Second Plating Layer: Concentration Gradient of Layer | Second Plating Layer: Deposition Amount (g/m²) | Second Plating Layer: Concentration of Element(s) other than Zn Fe | Ni | Co | Chemical Conversion Film: Deposition Amount mg/m² | Chemical Conversion Film: Kind | Third Plating Layer: Deposition Amount g/m² | Third Plating Layer: Concentration of Element(s) other than Fe (wt %) Zn | Cr | P | Plating Adherence | Unpainted Corrosion Resistance | Water Resistant Adherence | Post-painting Corrosion Resistance |
|---|---|---|---|---|---|---|---|---|---|---|---|---|---|---|---|---|---|---|---|---|
| Comparative | 4B-1 | 0 | — | — | — | Uniform | 20 | 0 | 11 | 0.2 | 0 | — | — | — | — | — | x | x | Δ | x |
| | −2 | 0 | — | — | — | " | 20 | 0 | 12 | 0.3 | 0 | — | 3.0 | 25 | 0 | 0 | x | x | o | x |
| | −3 | 0.1 | 0 | 0 | 100 | " | 20 | 0 | 9 | 0.1 | 0 | — | — | — | — | — | x~Δ | x | Δ | x |
| | −4 | 0.01 | 0 | 0 | 100 | " | 30 | 0 | 8 | 0.2 | 0 | — | 0.5 | 20 | 0 | 0 | x~Δ | x | Δ | x |
| | −5 | 0.001 | 0 | 0 | 100 | " | 10 | 0 | 15 | 0.5 | 0 | — | 2.0 | 15 | 0 | 0 | x~Δ | x | o | x |
| | −6 | 0.2 | 0 | 0 | 100 | " | 3 | 0 | 13 | 1.0 | 0 | — | 2.0 | 18 | 0 | 0 | x~Δ | x | o | x |
| | −7 | 0.3 | 0 | 0 | 100 | " | 15 | 0 | 10 | 2.0 | 0 | — | 0.2 | 5 | 0 | 0 | x~Δ | x | Δ | x |
| | −8 | 0.05 | 0 | 0 | 100 | " | 30 | 0 | 20 | 10.0 | 0 | — | 5.0 | 13 | 0 | 0 | x~Δ | x | o | x |
| | −9 | 0.08 | 0 | 0 | 100 | " | 40 | 0 | 2 | 0.5 | 0 | " | 4.0 | 20 | 0 | 0 | x~Δ | x | o | x |
| Invention | −10 | 2.0 | 0 | 0 | 100 | " | 50 | 0 | 13 | 1.0 | 0.05 | Chromate Film | 2.0 | 60 | 0 | 0 | o | Δ | o | Δ |
| | −11 | 1.5 | 0 | 0 | 100 | " | 20 | 0 | 12 | 0.1 | 0.08 | Phosphate Film | 10.0 | 1 | 0 | 0 | o | Δ | o | Δ |
| | −12 | 0.03 | 0 | 0 | 100 | " | 10 | 0 | 6 | 0.2 | 0.15 | Chromate Film | 1.0 | 20 | 0 | 0 | o | Δ | o | Δ |
| Invention | 4B-13 | 2.0 | 0 | 0 | 100 | Uniform | 20 | 0 | 10 | 0.3 | 0.43 | Phosphate Film | 5.0 | 25 | 0 | 0 | o | Δ | o | Δ |
| | −14 | 0.15 | 0 | 0 | 100 | " | 30 | 0 | 12 | 0.1 | 95.0 | Chromate Film | 3.0 | 17 | 0 | 0 | o | o | o | o |
| | −15 | 0.2 | 0 | 0 | 100 | " | 25 | 0 | 4 | 0.2 | 16.0 | Phosphate Film | 2.0 | 4 | 0 | 0 | o | o | o | o |
| | −16 | 0.18 | 0 | 0 | 100 | " | 15 | 0 | 19 | 0.5 | 80.5 | " | 4.0 | 29 | 0 | 0 | o | o | o | o |
| | −17 | 0.4 | 0 | 0 | 100 | " | 6 | 0 | 11 | 0.2 | 12.0 | Chromate Film | 2.0 | 15 | 0 | 0 | o | o | o | o |
| | −18 | 0.5 | 0 | 100 | 0 | " | 40 | 0 | 8 | 0.1 | 73.4 | Phosphate Film | 1.5 | 18 | 0 | 0 | o | o | o | o |
| | −19 | 1.0 | 100 | 0 | 0 | " | 10 | 0 | 14 | 0.2 | 25.0 | " | 3.0 | 20 | 0 | 0 | o | o | o | o |
| | −20 | 1.2 | 0 | 98 | 2 | " | 15 | 0 | 9 | 0.1 | 34.3 | Chromate Film | 2.0 | 9 | 0 | 0 | o | o | o | o |
| | −21 | 0.7 | 2 | 98 | 0 | " | 20 | 0 | 17 | 0.4 | 28.4 | " | 2.0 | 18 | 0 | 0 | o | o | o | o |
| | −22 | 0.6 | 1 | 98 | 1 | " | 20 | 0 | 12 | 0.5 | 41.3 | " | 1.5 | 24 | 0 | 0 | o | o | o | o |
| | −23 | 0.8 | 0 | 0 | 100 | Graded | 30 | 0 | *6 | 0.5 | 45.0 | " | 3.5 | 12 | 0 | 0 | o | o | o | o |
| | | | | | | | | *8 | 0.1 | | | | | | | | | | | |

Table 4 (C)

| | | First Plating Layer | | | | Second Plating Layer | | | | Chemical Conversion Film | | Third Plating Layer | | | | | | | |
|---|---|---|---|---|---|---|---|---|---|---|---|---|---|---|---|---|---|---|---|
| | | Deposition Amount | Concentration (wt %) | | | Concentration Gradient | Deposition Amount (wt %) | Concentration of Element(s) other than Zn | | | Deposition Amount | | Deposition Amount | Concentration of Element(s) other than Fe (wt %) | | | Plating Adherence | Unpainted Corrosion Resistance | Water Resistant Adherence | Post-painting Corrosion Resistance |
| | No. | (g/m²) | Fe | Ni | Co | of Layer | (g/m²) | Fe | Ni | Co | mg/m² | Kind | g/m² | Zn | Cr | P | | | | |
| Comparative | 4C-1 | 0 | — | — | — | Uniform | 20 | 0 | 11 | 0.2 | 0 | — | 0 | — | — | — | x | x | Δ | x |
| | −2 | 0 | — | — | — | " | 20 | 0 | 12 | 0.3 | 0 | — | 3.0 | 0 | 0 | 0.08 | x | x | o | x |
| | −3 | 0.1 | 0 | 0 | 100 | " | 20 | 0 | 9 | 0.1 | 0 | — | 0 | — | — | — | x~Δ | x | Δ | x |
| | −4 | 0.01 | 0 | 0 | 100 | " | 30 | 0 | 8 | 0.2 | 0 | — | 0.5 | 0 | 0 | 0.5 | x~Δ | x | Δ | x |
| | −5 | 0.001 | 0 | 0 | 100 | " | 10 | 0 | 15 | 0.5 | 0 | — | 2.0 | 0 | 0 | 0.38 | x~Δ | x | o | x |
| | −6 | 0.2 | 0 | 0 | 100 | " | 3 | 0 | 13 | 1.0 | 0 | — | 2.0 | 0 | 0 | 0.12 | x~Δ | x | o | x |
| | −7 | 0.3 | 0 | 0 | 100 | " | 15 | 0 | 10 | 2.0 | 0 | — | 0.2 | 0 | 0 | 0.19 | x~Δ | x | Δ | x |
| | −8 | 0.05 | 0 | 0 | 100 | " | 30 | 0 | 20 | 10.0 | 0 | — | 5.0 | 0 | 0 | 1.57 | x~Δ | x | o | x |
| | −9 | 0.08 | 0 | 0 | 100 | " | 40 | 0 | 2 | 0.5 | 0 | — | 4.0 | 0 | 0 | 1.57 | x~Δ | x | o | x |
| Invention | −10 | 2.0 | 0 | 0 | 100 | " | 50 | 0 | 13 | 1.0 | 0.05 | Chromate Film | 2.0 | 0 | 0 | 35.6 | o | Δ | o | Δ |
| | −11 | 1.5 | 0 | 0 | 100 | " | 20 | 0 | 12 | 0.1 | 0.08 | Phosphate Film | 10.0 | 0 | 0 | 0 | o | Δ | o | Δ |
| | −12 | 0.03 | 0 | 0 | 100 | " | 10 | 0.1 | 6 | 0.2 | 0.15 | Chromate Film | 1.0 | 0 | 0 | 0.02 | o | Δ | o | Δ |
| Invention | 4C-13 | 2.0 | 0 | 0 | 100 | Uniform | 20 | 0.1 | 10 | 0.3 | 0.43 | Phosphate Film | 5.0 | 0 | 0 | 25.3 | o | Δ | o | Δ |
| | −14 | 0.15 | 0 | 0 | 100 | " | 30 | 0.1 | 12 | 0.1 | 95.0 | Chromate Film | 3.0 | 0 | 0 | 0.68 | o | o | o | o |
| | −15 | 0.2 | 0 | 0 | 100 | " | 25 | 0.1 | 4 | 0.2 | 16.0 | Phosphate Film | 2.0 | 0 | 0 | 1.54 | o | o | o | o |
| | −16 | 0.18 | 0 | 0 | 100 | " | 15 | 0.1 | 19 | 0.5 | 80.5 | " | 4.0 | 0 | 0 | 2.50 | o | o | o | o |
| | −17 | 0.4 | 0 | 0 | 100 | " | 6 | 0.1 | 11 | 0.2 | 12.0 | Chromate Film | 2.0 | 0 | 0 | 0.08 | o | o | o | o |
| | −18 | 0.5 | 0 | 100 | 0 | " | 40 | 0.1 | 8 | 0.1 | 73.4 | Phosphate Film | 1.5 | 0 | 0 | 1.23 | o | o | o | o |
| | −19 | 1.0 | 100 | 0 | 0 | " | 10 | 0.1 | 14 | 0.2 | 25.0 | " | 3.0 | 0 | 0 | 4.56 | o | o | o | o |
| | −20 | 1.2 | 0 | 98 | 2 | " | 15 | 0.1 | 9 | 0.1 | 34.3 | Chromate Film | 2.0 | 0 | 0 | 7.2 | o | o | o | o |
| | −21 | 0.7 | 2 | 98 | 0 | " | 20 | 0.1 | 17 | 0.4 | 28.4 | " | 2.0 | 0 | 0 | 5.60 | o | o | o | o |
| | −22 | 0.6 | 1 | 98 | 1 | " | 20 | 0.1 | 12 | 0.5 | 41.3 | " | 1.5 | 0 | 0 | 4.9 | o | o | o | o |
| | −23 | 0.8 | 0 | 0 | 100 | Graded | 30 | 0.1 | *6<br>*8 | 0.5<br>0.1 | 45.0 | " | 3.5 | 0 | 0 | 1.02 | o | o | o | o |

TABLE 4 (D)

| | First Plating Layer | | | | Second Plating Layer | | | | | | | | | | | | | Third Plating Layer | | | | | | Evaluation | | | |
|---|---|---|---|---|---|---|---|---|---|---|---|---|---|---|---|---|---|---|---|---|---|---|---|---|---|---|---|
| | | | | | | | Concentration of Element(s) other than Zn (wt %) | | | | | | | | | | | Chemical Conversion Film | | | Concentration of Element(s) other than Fe (wt %) | | | | | | |
| No. | Deposition Amount (g/m²) | Concentration (wt %) Fe | Ni | Co | Concentration Gradient of Layer | Deposition Amount (g/m²) | Fe | Ni | Co | Cr | Mn | Ti | Sn | Cu | Cd | Pd | Deposition Amount mg/m² | Kind | Deposition Amount g/m² | Zn | Cr | P | Plating Adherence | Unpainted Corrosion Resistance | Water Resistant Adherence | Post painting Corrosion Resistance |
| 4D-1 | 0.15 | 100 | 0 | 0 | Uniform | 20 | 0.5 | 12.2 | 0.27 | 0.04 | 0.02 | 0.04 | 0.03 | 0.02 | 0.01 | 0.01 | 0.5 | Chromate Film | 3.1 | 21 | 0 | 0 | o | Δ | o | Δ |
| −2 | 0.54 | 0 | 100 | 0 | " | 20 | 0.05 | 9.7 | 0.23 | 0 | 0 | 0 | 0 | 0 | 0 | 0.01 | 0.8 | Phosphate Film | 2.6 | 16 | 0.15 | 0 | o | Δ | o | Δ |
| −3 | 0.78 | 0 | 0 | 100 | " | 15 | 0.04 | 8.5 | 0.05 | 0 | 0 | 0 | 0.01 | 0 | 0 | 0 | 2.5 | Chromate Film | 1.8 | 28 | 0 | 0 | o | o | o | o |
| −4 | 0.15 | 0 | 100 | 0 | " | 30 | 0 | 0.1 | 15.2 | 0 | 0.02 | 0.05 | 0.1 | 0 | 0 | 0 | 15.0 | " | 2.3 | 0 | 0 | 0.08 | o | o | o | o |
| −5 | 0.69 | 0.1 | 99.9 | 0 | " | 18 | 0 | 0 | 0 | 0 | 15.2 | 0 | 0 | 0 | 0 | 0 | 25.0 | " | 1.9 | 20 | 0 | 0 | o | o | o | o |
| −6 | 0.12 | 0 | 0 | 100 | " | 36 | 0.5 | 12.2 | 0.27 | 0.40 | 0.98 | 0.80 | 0.26 | 0.15 | 0.58 | 0.11 | 50.0 | Phosphate Film | 3.5 | 0 | 0 | 0.98 | o | o | o | o |
| −7 | 0.56 | 100 | 0 | 0 | " | 60 | 0.05 | 9.7 | 0.23 | 0 | 0 | 0 | 0 | 0 | 0 | 0.01 | 78.2 | " | 2.7 | 13 | 0.36 | 0 | o | o | o | o |
| −8 | 0.79 | 0 | 100 | 0 | " | 18 | 0.04 | 8.5 | 0.05 | 0 | 0 | 0 | 0.01 | 0 | 0 | 0 | 16.3 | " | 1.2 | 28 | 0.15 | 0 | o | o | o | o |
| −9 | 0.14 | 0 | 0 | 100 | " | 32 | 0 | 0.1 | 15.2 | 0 | 0.02 | 0.05 | 0.1 | 0 | 0 | 0 | 39.8 | " | 2.9 | 0 | 0 | 8.68 | o | o | o | o |
| −10 | 0.62 | 0.2 | 99.8 | 0 | " | 17 | 0 | 0 | 0 | 0 | 15.2 | 0 | 0 | 0 | 0 | 0 | 26.5 | Chromate Film | 1.4 | 24 | 0.5 | 0 | o | o | o | o |

TABLE 4 (E)

| | | First Plating Layer | | | | Second Plating Layer | | | Chemical Conversion Film | | Third Plating Layer | | | | | Evaluation | | |
|---|---|---|---|---|---|---|---|---|---|---|---|---|---|---|---|---|---|---|
| | | | Concentration (wt %) | | | | Concentration of Element(s) other than Zn (wt %) | | | | | Concentration of Element(s) other than Fe (wt %) | | | | | | |
| | No. | Deposition Amount ($g/m^2$) | Fe | Ni | Co | Deposition Amount ($g/m^2$) | | Particles | Deposition Amount $mg/m^2$ | Kind | Deposition Amount $g/m^2$ | Zn | Cr | P | Plating Adherence | Unpainted Corrosion Resistance | Water Resistant Adherence | Post painting Corrosion Resistance |
| Comparative | 4E-1 | 0 | — | — | — | 20 | 11% Ni - 0.3% Co | 3% $SiO_2$ | 0 | — | 0 | — | — | — | x | x | Δ | x |
| | 2 | 0 | — | — | — | 20 | 11% Ni - 0.3% Co | 3% $TiO_2$ | 0 | — | 3.0 | 3 | 1.0 | 0 | x | x | o | x |
| | 3 | 0.1 | 100 | 0 | 0 | 20 | 15% Fe | 5% $SiO_2$ | 0 | — | 0 | — | — | — | x~Δ | x | Δ | x |
| | 4 | 0.01 | 0 | 100 | 0 | 20 | 15% Fe | 5% $ZrO_2$ | 0 | — | 0.5 | 0 | 0 | 0.01 | x~Δ | x | Δ | x |
| | 5 | 0.001 | 0 | 0 | 100 | 20 | 12% Ni | 2% $SiO_2$ | 0 | — | 2.0 | 15 | 0 | 0 | x~Δ | x | o | x |
| | 6 | 0.2 | 0.1 | 99.9 | 0 | 3 | 12% Ni | 3% $BaCrO_4$ | 0 | — | 2.0 | 0 | 0 | 1 | x~Δ | x | o | x |
| | 7 | 0.3 | 100 | 0 | 0 | 20 | 1% Fe - 12% Ni | 1% $TiO_2$ | 0 | — | 0.2 | 10 | 0.3 | 0 | x~Δ | x | Δ | x |
| | 8 | 0.05 | 0 | 100 | 0 | 20 | 15% Fe - 1% Co | 1% $Al_2O_3$ | 0 | — | 5.0 | 29 | 0.1 | 0 | x~Δ | x | o | x |
| Invention | 9 | 2.0 | 0 | 0 | 100 | 20 | 2% Fe - 11% Ni - 0.1% Cr | 1% $PbCrO_4$ | 0.05 | Phosphate Film | 2.0 | 25 | 5.0 | 0 | o | Δ | o | Δ |
| | 10 | 1.5 | 0 | 94 | 1 | 20 | 5% Co - 0.1% Cr | 3% $Al_2O_3$ | 0.08 | Chromate Film | 10.0 | 2 | 0.05 | 0 | o | Δ | o | Δ |
| Invention | 11 | 0.1 | 100 | 0 | 0 | 20 | 11% Ni - 0.3% Co | 3% $SiO_2$ | 0.5 | Chromate Film | 3.0 | 3 | 0 | 0 | o | Δ | o | Δ |
| | 12 | 0.2 | 0 | 100 | 0 | 20 | 11% Ni - 0.3% Co | 3% $TiO_2$ | 0.8 | Phosphate Film | 2.5 | 3 | 1.0 | 0 | o | Δ | o | Δ |
| | 13 | 0.1 | 0 | 0 | 100 | 20 | 15% Fe | 5% $SiO_2$ | 2.5 | Chromate Film | 2.0 | 30 | 0 | 0 | o | o | o | o |
| | 14 | 0.01 | 0 | 100 | 0 | 20 | 15% Fe | 5% $ZrO_2$ | 15.0 | " | 2.0 | 0 | 0 | 0.01 | o | o | o | o |
| | 15 | 0.01 | 0.1 | 99.9 | 0 | 20 | 12% Ni | 2% $SiO_2$ | 25.0 | " | 2.0 | 15 | 0 | 0 | o | o | o | o |
| | 16 | 0.2 | 0 | 0 | 100 | 20 | 12% Ni | 3% $BaCrO_4$ | 50.0 | Phosphate Film | 3.5 | 0 | 0 | 1 | o | o | o | o |
| | 17 | 0.3 | 100 | 0 | 0 | 20 | 1% Fe - 12% Ni | 1% $TiO_2$ | 78.0 | " | 3.0 | 10 | 0.3 | 0 | o | o | o | o |
| | 18 | 0.05 | 0 | 100 | 0 | 20 | 15% Fe - 1% Co | 1% $Al_2O_3$ | 16.0 | " | 1.0 | 29 | 0.1 | 0 | o | o | o | o |
| | 19 | 2.0 | 0 | 0 | 100 | 20 | 2% Fe - 11% Ni - 0.1% Cr | 1% $PbCrO_4$ | 40.0 | " | 3.0 | 0 | 0 | 30 | o | o | o | o |
| | 20 | 1.5 | 0.2 | 99.8 | 0 | 20 | 5% Co - 0.1% Cr | 3% $Al_2O_3$ | 25.0 | Chromate Film | 1.5 | 20 | 0 | 0 | o | o | o | o |
| | 21 | 0.1 | 0 | 100 | 0 | 20 | 10% Ni | 5% $SiO_2$ | 3 | " | 3.0 | 15 | 0 | 0 | o | o | o | o |
| | 22 | 0.1 | 0 | 100 | 0 | 20 | 10% Ni | 3% $BaCrO_4$ | 3 | " | 3.0 | 15 | 0 | 0 | o | o | o | o |
| | 23 | 0.1 | 100 | 0 | 0 | 20 | 10% Ni | 1% graphite | 3 | " | 3 | 15 | 0 | 0 | o | o | o | o |
| | 24 | 0.2 | 0 | 100 | 0 | 20 | 20% Fe | 1% Cr | 3 | " | 3 | 15 | 0 | 0 | o | o | o | o |
| | 25 | 0.1 | 0 | 0 | 100 | 20 | Zr | 3% Al | 3 | Phosphate Film | 3 | 15 | 0 | 0 | o | o | o | o |
| Comparative | 26 | 0.1 | 0 | 0 | 100 | 20 | Zr | " | — | — | 3 | 15 | 0 | 0 | x~Δ | x | o | x |

We claim:

1. A steel material having at least one lower plated layer of material plated directly on the steel selected from the group consisting of Zn, a Zn series alloy, and a Zn composite material, an upper plated layer of material selected from the group consisting of Fe, Ni, Co and Fe-series alloy, and a chemical conversion layer interposed between the upper and lower plated layers.

2. A steel material according to claim 1, in the form of a sheet and having said plated layers on at least one surface of said sheet.

3. A steel material according to claim 1, wherein said chemical conversion layer is a phosphate layer formed by phosphatizing.

4. A steel material according to claim 3, wherein said chemical conversion phosphate layer is in an amount of approximately 100 $mg/m^2$ or less in terms of P (phosphorous).

5. A steel material according to claim 3, wherein said chemical conversion layer is a chromate layer formed by chromating.

6. A steel material according to claim 3, wherein said chemical conversion chromate layer is in an amount of approximately 100 $mg/m^2$ or less in terms of Cr (chromium).

7. A steel material according to claim 2, 3, 4, 5 or 6, wherein at least one of said lower plated layers comprises a Zn series-alloy or Zn-composite material and said upper plated layer comprises an Fe-series alloy containing at least 70% by weight Fe.

8. A steel material comprising a lower plated layer of a metal plated directly on the steel selected from the group consisting of Fe, Ni and Co, an upper plated layer comprising an Fe-series alloy containing at least 70% by weight Fe, a middle plated layer comprising a Zn series alloy or Zn-composite material between said lower and upper plated layers and a chemical conversion layer interposed between said middle and upper plated layers.

9. A steel material according to claim 8, wherein said chemical conversion layer is a phosphate layer formed by phosphatizing.

10. A steel material according to claim 9, wherein said chemical conversion phosphate layer is in an amount of approximately 100 $mg/m^2$ or less in terms of P (phosphorous).

11. A steel material according to claim 9, wherein said chemical conversion layer is a chromate layer formed by chromating.

12. A steel material according to claim 9, wherein said chemical conversion chromate layer is in an amount of approximately 100 $mg/m^2$ or less in terms of Cr (chromium).

* * * * *